US007427131B2

(12) United States Patent
Okamoto et al.

(10) Patent No.: US 7,427,131 B2
(45) Date of Patent: Sep. 23, 2008

(54) BELT CONVEYING MECHANISM FOR INK-JET RECORDING APPARATUS AND INK-JET RECORDING APPARATUS INCLUDING IT

(75) Inventors: Tsugio Okamoto, Kani (JP); Masakazu Kuki, Ichinomiya (JP); Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 842 days.

(21) Appl. No.: 10/667,497

(22) Filed: Sep. 23, 2003

(65) Prior Publication Data

US 2004/0100544 A1 May 27, 2004

(30) Foreign Application Priority Data

Sep. 24, 2002 (JP) ..... 2002-277219
Sep. 24, 2002 (JP) ..... 2002-277894
Sep. 26, 2002 (JP) ..... 2002-280183

(51) Int. Cl.
*B41J 2/01* (2006.01)

(52) U.S. Cl. ..... 347/104; 347/103; 347/101

(58) Field of Classification Search ..... 347/104, 347/103, 101, 32, 31, 22
See application file for complete search history.

(56) References Cited

U.S. PATENT DOCUMENTS 6,511,152 B2 1/2003 Yoshimura
7,021,756 B2 * 4/2006 Nakashima et al. ..... 347/104
7,040,734 B2 * 5/2006 Nakashima et al. ..... 347/33
2001/0028372 A1 10/2001 Yoshimura

FOREIGN PATENT DOCUMENTS

| | | |
|---|---|---|
| JP | A-06-031926 | 2/1994 |
| JP | A-06-071897 | 3/1994 |
| JP | A-06-320757 | 11/1994 |
| JP | A 7-1724 | 1/1995 |
| JP | A-09-109377 | 4/1997 |
| JP | A 11-192694 | 7/1999 |
| JP | A 2000-272110 | 10/2000 |
| JP | A 2001-105628 | 4/2001 |
| JP | A 2001-113690 | 4/2001 |
| JP | A-2001-113690 | 4/2001 |
| JP | A 2001-277656 | 10/2001 |
| JP | A 2001-287377 | 10/2001 |
| JP | A 2001-302012 | 10/2001 |

* cited by examiner

*Primary Examiner*—Manish S Shah
(74) *Attorney, Agent, or Firm*—Oliff & Berridge, PLC

(57) ABSTRACT

An ink-jet printer is provided with a belt conveying mechanism which includes two rollers and a conveyor belt that is wrapped around the two rollers for carrying paper. The surface of the conveyor belt is formed with a recessed portion into which ink is ejected during flushing. The recessed portion has a non-water-repellent region upstream in a traveling direction of the conveyor belt. The non-repellent region functions as an ink retaining portion retaining. On a rear surface of the conveyor belt is disposed an ink absorber for absorbing ink retained in the non-water-repellent region from the rear surface.

24 Claims, 16 Drawing Sheets

BELT CONVEYING MECHANISM FOR INK-JET RECORDING APPARATUS AND INK-JET RECORDING APPARATUS INCLUDING IT

BACKGROUND OF THE INVENTION

1. Field of the Invention

The present invention relates to a belt conveying mechanism for use in conveying a record medium in an ink-jet recording apparatus that conducts recording by ejecting ink onto a record medium, and also to an ink-jet recording apparatus including the belt conveying mechanism.

2. Description of the Related Art

An ink-jet recording apparatus is an apparatus which causes ink ejected from nozzles formed in heads to adhere to paper to thereby form a desired image on the paper. In such an ink-jet recording apparatus, a belt conveying mechanism is sometimes used as a mechanism for conveying the paper serving as a record medium. In a case where the length occupied by the heads in the conveying direction of the paper is long, a relatively short piece of paper cannot be conveyed with a roller conveying mechanism, which nips and carries the paper between plural roller pairs without using a belt. It is however possible for the belt conveying mechanism to convey such a short piece of paper.

In an ink-jet recording apparatus, when the state where ink is not ejected from the nozzles continues for along period of time, the surfaces of the ink meniscuses dry and poor ink ejection arises. In order to prevent this, it is necessary to periodically conduct so-called flushing in which the ink is forcibly ejected from the nozzles towards a location other than the paper when printing is not being conducted.

In the case of a serial-type ink-jet recording apparatus where the heads reciprocatingly move in a direction orthogonal to the conveying direction of the paper, flushing can be rapidly conducted by moving the heads to a position offset from the paper conveying path when printing is not being conducted. However, in the case of a line-type ink-jet recording apparatus where the heads are fixedly disposed along the direction orthogonal to the paper conveying direction, for example, when the aforementioned belt conveying mechanism is adopted as the paper conveying mechanism, it is necessary to move a member that catches the ink to a position facing the heads after the belt conveying mechanism or the heads has/have been retreated. Therefore, the configuration becomes complicated, and it is difficult to conduct flushing rapidly.

Thus, techniques have been developed that enable rapid flushing in a line-type ink-jet recording apparatus employing a belt conveying mechanism. In an example, an opening is disposed in a portion of the conveyor belt, and a recovery mechanism including an absorber is disposed at a position facing the heads with the conveyor belt sandwiched therebetween. When the opening in the conveyor belt is positioned below the heads, ink is ejected towards the opening and absorbed by the recovery mechanism.

However, in the above-described technique, there is a problem in that the strength of the conveyor belt significantly drops due to the presence of the opening in the conveyor belt. As a result, a desired belt tension cannot be obtained, the paper-conveying function of the conveyor belt drops, and the life of the conveyor belt becomes short.

SUMMARY OF THE INVENTION

It is therefore an object of the present invention to provide a belt conveying mechanism for an ink-jet recording apparatus that enables rapid flushing in a line-type ink-jet recording apparatus with a relatively simple configuration and that is less susceptible to drop in the strength of a conveyor belt, and also to provide an ink-jet recording apparatus including the belt conveying mechanism.

In order to achieve the above object, according to a first aspect of the present invention there is provided a belt conveying mechanism for an ink-jet recording apparatus, comprising a plurality of rollers; a conveyor belt for conveying a record medium on a surface of the converor belt, the conveyor belt wrapped around the plurality of rollers; a recessed portion formed in a surface of the conveyor belt; an ink retaining portion for retaining ink, the ink retaining portion disposed upstream in a traveling direction of the conveyor belt and ranging from a bottom surface of the recessed portion to a rear surface of the conveyor belt; and an ink absorber for absorbing the ink retained by the ink retaining portion from the rear surface of the conveyor belt by contacting with the ink retaining portion, the ink absorber disposed at the rear surface of the conveyor belt.

To attain the above object, according to a second aspect of the present invention there is provided a belt conveying mechanism for an ink-jet recording apparatus, comprising a plurality of rollers; a conveyor belt for conveying a record medium on a surface of the converor belt, the conveyor belt wrapped around the plurality of rollers; a recessed portion formed in the surface of the conveyor belt such that ink moves towards at least one width end portion of the conveyor belt in accompaniment with the traveling of the conveyor belt; and an ink retainer for retaining the ink moved in the recessed portion, the ink retainer disposed at the width end portion.

To accomplish the above object, according to a third aspect of the present invention there is provided a belt conveying mechanism for an ink-jet recording apparatus, comprising a plurality of rollers; a conveyor belt for conveying a record medium on a surface of the converor belt, the conveyor belt wrapped around the plurality of rollers; a gas delivery member for delivering a gas in a direction intersecting the traveling direction of the conveyor belt along the surface of the conveyor belt from the delivery portion, the gas delivery member including a delivery portion disposed at one width-direction end of the conveyor belt; and an ink retainer for retaining the ink moved under the action of the gas delivered from the gas delivery member, the ink retainer disposed at the other width-direction end of the conveyor belt, in such a manner as to face the delivery portion of the gas delivery member in the gas delivery direction.

In the configurations according to the above-described first, second and third aspects, rapid flushing becomes possible with a relatively simple configuration by ejecting ink towards the recessed portion even if the conveyor belt or the heads is/are not retreated. Also, a drop in the strength of the conveyor belt can be reduced because the conveyor belt has no opening formed therein.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
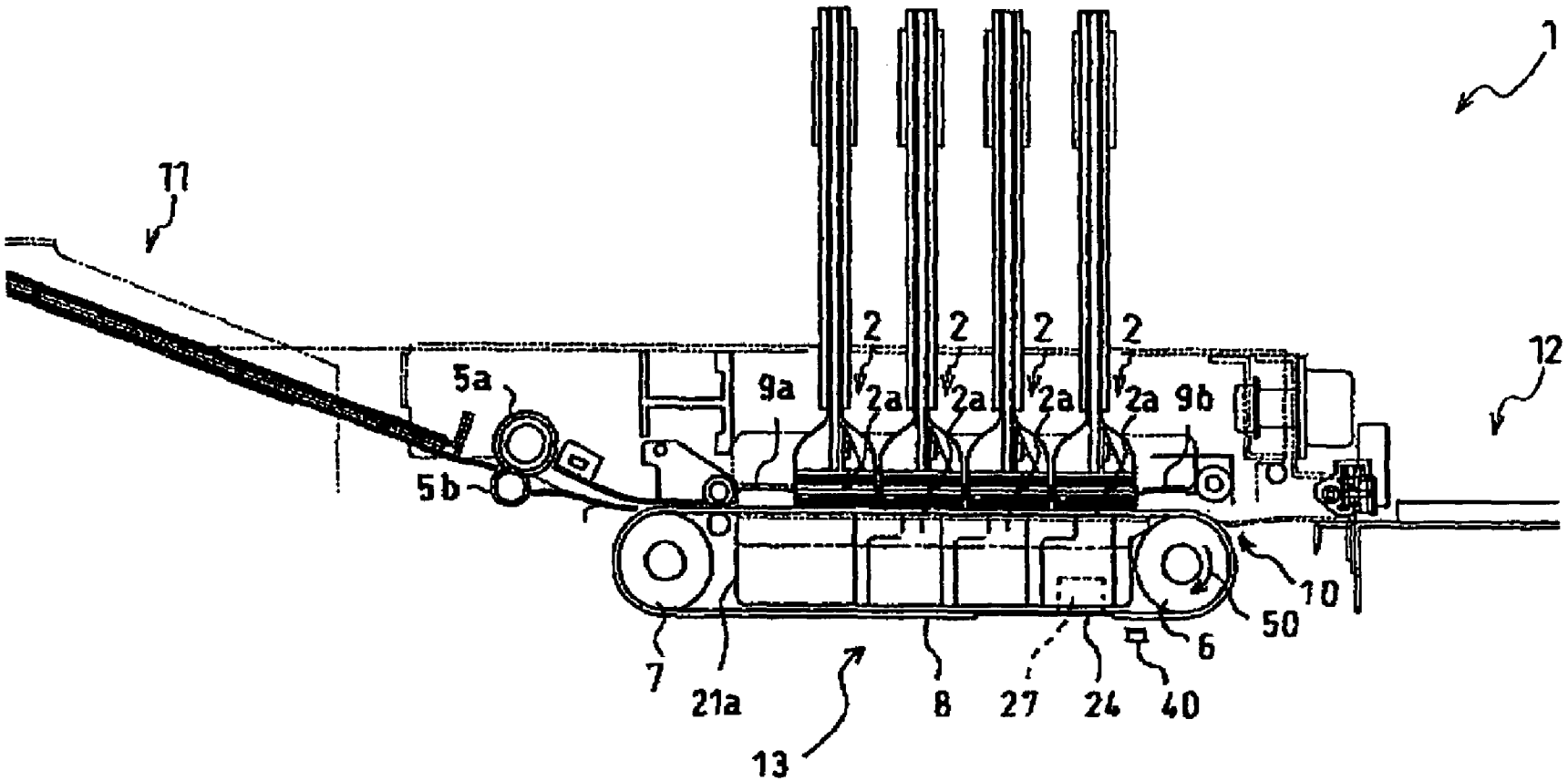
FIG. 1 is a front view showing an ink-jet printer, i.e., an ink-jet recording apparatus provided with a belt conveying mechanism in accordance with a first embodiment of the invention.

First, referring to FIG. 1, description will be made of the overall configuration of an ink-jet printer provided with a belt conveying mechanism in accordance with a first embodiment of the invention. An ink-jet printer 1 of this embodiment is a color ink-jet printer provided with four ink-jet heads 2. The ink-jet printer 1 includes a paper feed section 11 on the left in the diagram and a paper discharge section 12 on the right in the diagram. A paper conveying path extending from the paper feed section 11 to the paper discharge section 12 is formed inside the apparatus.

A pair of paper feed rollers 5*a* and 5*b* are disposed immediately downstream of the paper feed section 11. Paper serving as a record medium is sent from left to right in the diagram. At an intermediate portion of the paper conveying path are disposed two rollers 6 and 7 and a conveyor belt 8 that is wrapped around the rollers 6 and 7 so as to span the distance therebetween.

Figure 3:
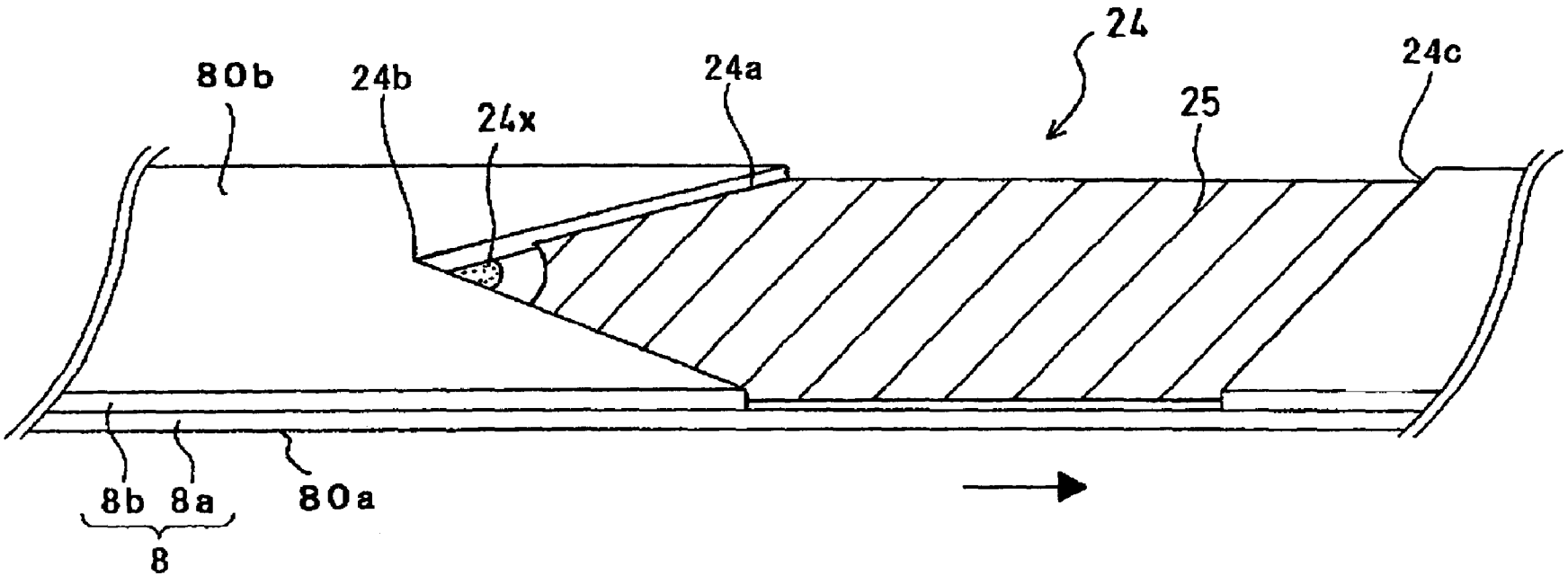
FIG. 3 is a partial perspective view of the conveyor belt shown in FIG. 1.

The conveyor belt 8 has a two-layer structure of silicone rubber and a polyester base material impregnated with urethane (see FIG. 3). The surface on the conveying surface side is adhesive by silicone rubber. Paper conveyed by the pair of paper feed rollers 5*a* and 5*b* is retained by adhesion on the conveying surface of the conveyor belt 8 surface and is conveyed downstream in the conveying direction, i.e., toward the right in the diagram, by the driving force of the roller 6 being rotated clockwise, i.e., in the direction of arrow 50.

Press members 9*a* and 9*b* are respectively disposed at insertion and discharge positions of the paper with respect to the roller 6. The press members 9*a* and 9*b* are for pressing the paper against the conveying surface of the conveyor belt 8 to ensure that the paper on the conveyor belt 8 does not rise from the conveying surface but that the paper is reliably conveyed on the conveying surface.

A separation mechanism 10 is disposed downstream, i.e., to the right in the diagram, of the conveyor belt 8 in the conveying direction along the paper conveying path. The separation mechanism 10 separates the paper, which is retained by adhesion on the conveying surface of the conveyor belt 8, from the conveying surface, and send the paper towards the paper discharge section 12 on the right.

The four ink-jet heads 2 respectively include a head main body 2*a* at lower ends thereof. Each head main body 2*a* has a rectangular cross section, and the head main bodies 2*a* are disposed in mutual proximity so that the longitudinal direction thereof is a direction perpendicular to the paper conveying direction, i.e., the direction perpendicular to the drawing plane of FIG. 1. In other words, the printer 1 is a line-type printer. A multiplicity of nozzles are disposed in each bottom surface of the four head main bodies 2*a*, and magenta, yellow, cyan and black inks are respectively ejected from the four head main bodies 2*a*.

Each head main body 2*a* is disposed so that a small gap is formed between the lower surface thereof and the conveying surface 80*b* of the conveyor belt 6, and the paper conveying path is formed in this gap portion. Thus, when the paper conveyed by the conveyor belt 8 successively passes directly below the four head main bodies 2*a*, the inks of the respective colors are ejected from the nozzles towards the upper surface, i.e., a printing surface of the paper, whereby a desired color image can be formed on the paper.

A photosensor 40 for detecting the position of the conveyor belt 8, more specifically, the position of a non-water-repellent region (hydrophilic region; hereinafter the same) 24*x* described later is disposed near the roller 6 on the lower path of the conveyor belt 8. The photosensor 40 is disposed away from the front surface 80*b* of the conveyor belt 8 and includes a light-emitting portion and a light-receiving portion.

Figure 4:
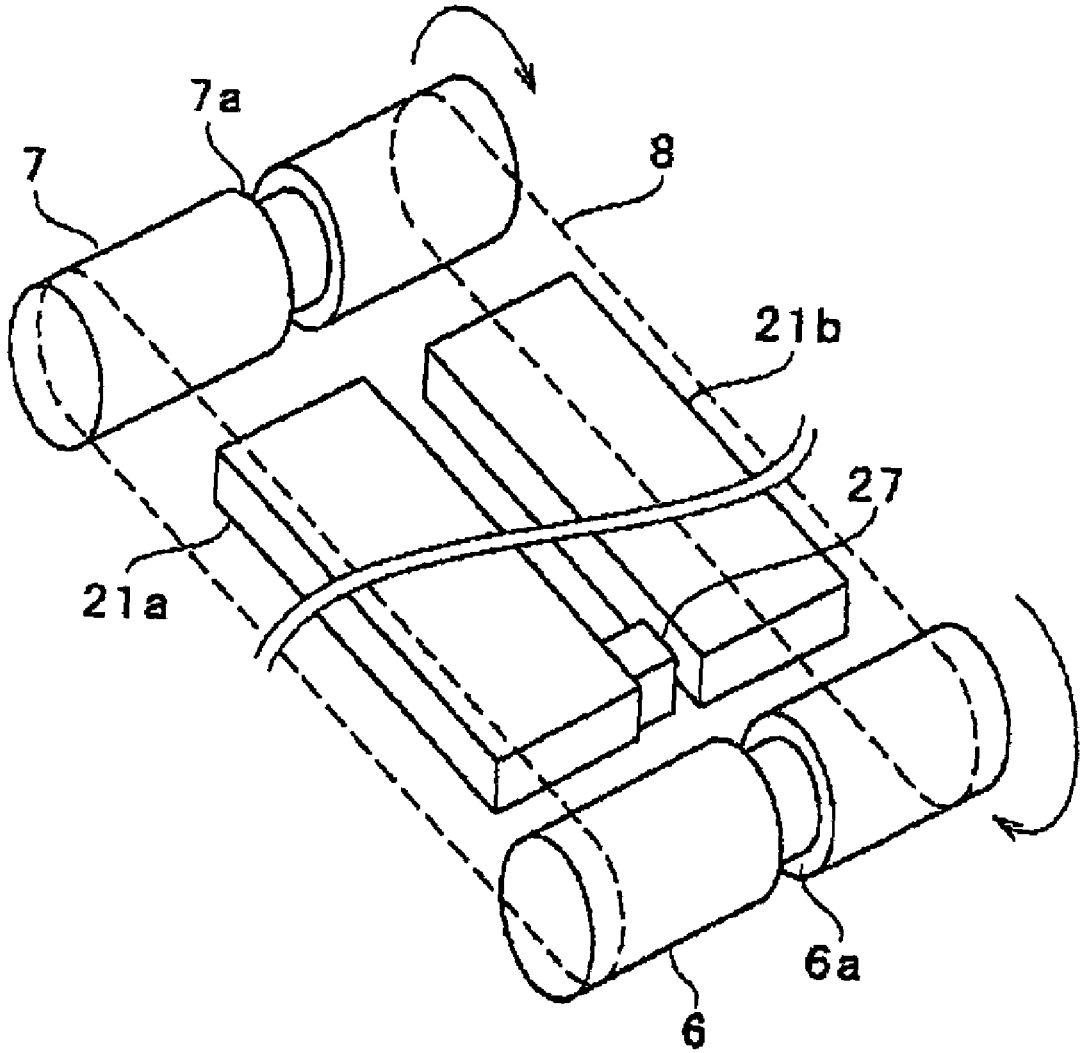
FIG. 4 is a perspective view of a peripheral region of two rollers shown in FIG. 1.

Two guide members 21*a* and 21*b* of which only the guide member 21*a* is shown in FIG. 1 (see FIG. 4 for the guide member 21*b*), which support the conveyor belt 8 from the rear surface 80*a* thereof by contacting the rear surface 80*a* of the conveyor belt 8 on the upper path facing the ink-jet heads 2, are disposed in a region enclosed by the conveyor belt 8. As shown in FIGS. 1 and 4, an ink absorber 27, which is made of felt and substantially rectangular parallelepiped-shaped, is disposed between the two guide members 21*a* and 21*b*.

A belt conveying mechanism 13 of this embodiment is configured by the guide members 21*a* and 21*b*, the ink absorber 27 and the conveyor belt 8.

The conveyor belt 8, au described above, has a two-layer structure formed by two sheets being adhered together. An inner sheet 8*a* is made of polyester base material impregnated with urethane, and an outer sheet 8*b* is made of silicone rubber (see FIG. 3). Additionally, because part of the inner sheet 8*a* is not covered by the outer sheet 8*b*, a single recessed portion 24 that has a height that is the same as the thickness of the outer sheet 8*b* is disposed in the outer peripheral surface of the conveyor belt 8.

It should be noted that the timing at which the paper is conveyed in the ink-jet printer 1 is adjusted so that the paper is conveyed by the portion other than the recessed portion 24.

Figure 2:
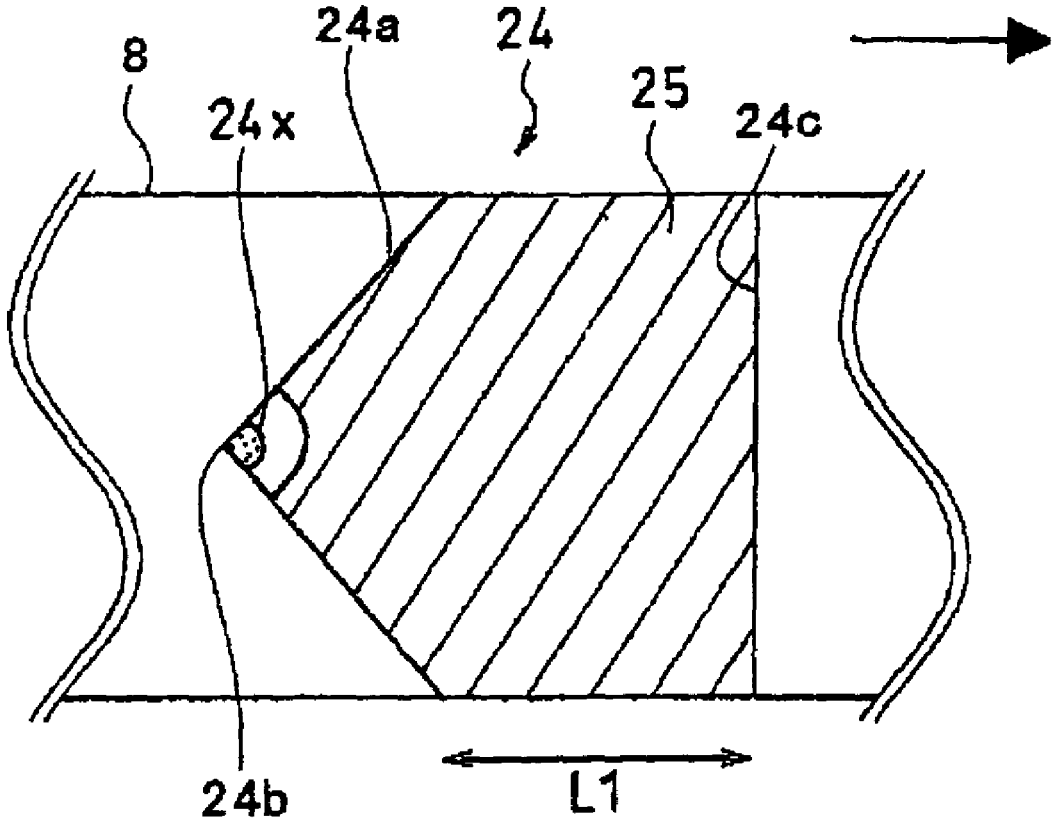
FIG. 2 is a partial plan view of a conveyor belt shown in FIG. 1.

As shown in FIGS. 2 and 3, the recessed portion 24 is of a pentagonal shape having a width that is equal to the width of the belt when seen in plan view. The recessed portion has a stepped portion 24*a* upstream in the traveling direction of the conveyor belt 8 (the direction represented by the arrow in the diagram; this direction will be referred to below simply as "the traveling direction"), the stepped portion 24*a* being "V" shaped, with an apex 24*b* upstream in the traveling direction at a width-direction center of the belt. A stepped portion 24*c* downstream in the traveling direction is of a straight linear shape along the belt width direction.

A water-repellent sheet 25 (see FIGS. 6A to 6D), whose surface has been administered a water-repellent finish by coating the surface with a silicon agent or the like, is disposed in the large portion of the bottom surface of the recessed portion 24 so that virtually no ink is absorbed. As shown in FIGS. 2 and 3, the water-repellent sheet 25 is not disposed in the vicinity of the apex 24*b* at the traveling direction upstream side of the bottom surface of the recessed portion 24; rather, this vicinity serves as the non-water-repellent region 24*x*. The non-water-repellent region 24*x* ranges from the bottom surface of the recessed portion 24 to the rear surface 80*a* of the conveyor belt 8. The non-water-repellent region 24*x* can retain ink in the gap thereof due to the capillary force of fibers, In other words, in this embodiment, the non-water-repellent portion 24*x* is an ink retaining portion for retaining ink.

Also, in the recessed portion 24, a distance L1 between the traveling direction downstream end portion of the stepped portion 24*a* and the stepped portion 24*c* is a distance that is somewhat longer than twice the width of a head main body 2*a*. As will be described later, this is because the distance is set so that the flushing of ink into the recessed portion 24 is conducted using two ink-jet heads 2 as a unit.

The position of the non-water-repellent region 24*x* formed in the bottom surface of the recessed portion 24 is detectable by the aforementioned photosensor 40 (see FIG. 1). The light-emitting portion in the photosensor 40 continually emits light towards the front surface 80*b* of the conveyor belt 8, and light reflected by the front surface 80*b* of the conveyor belt 8 is received by the light-receiving portion. Whether or not the non-water-repellent region 24*x* is at the disposed position of the photosensor 40 is detected from the intensity of the reflected light detected by the light-receiving portion. On the basis of this and the traveling speed of the conveyor belt 8, it is possible to know the position of the non-water-repellent region 24*x* at an optional point in time.

As shown in FIG. 4, the two rollers are cut out at longitudinal-direction center portion vicinities, more specifically, at the portions where the non-water-repellent region 24*x* passes at the time the conveyor belt 8 is traveling, so that annular recessed portions 6*a* and 7*a* having smaller diameters than the peripheries are respectively formed in the rollers 6 and 7. The two guide members 21*a* and 21*b* are rectangular parallelepipeds of the same size and are separated by a width that is the same as that of these recessed portions 6*a* and 7*a* at positions corresponding to the recessed portions 6*a* and 7*a*. Thus, the non-water-repellent region 24*x* does not contact the rollers 6 and 7 or the guide members 21*a* and 21*b* even when the conveyor belt 8 is traveling.

Figure 5A:
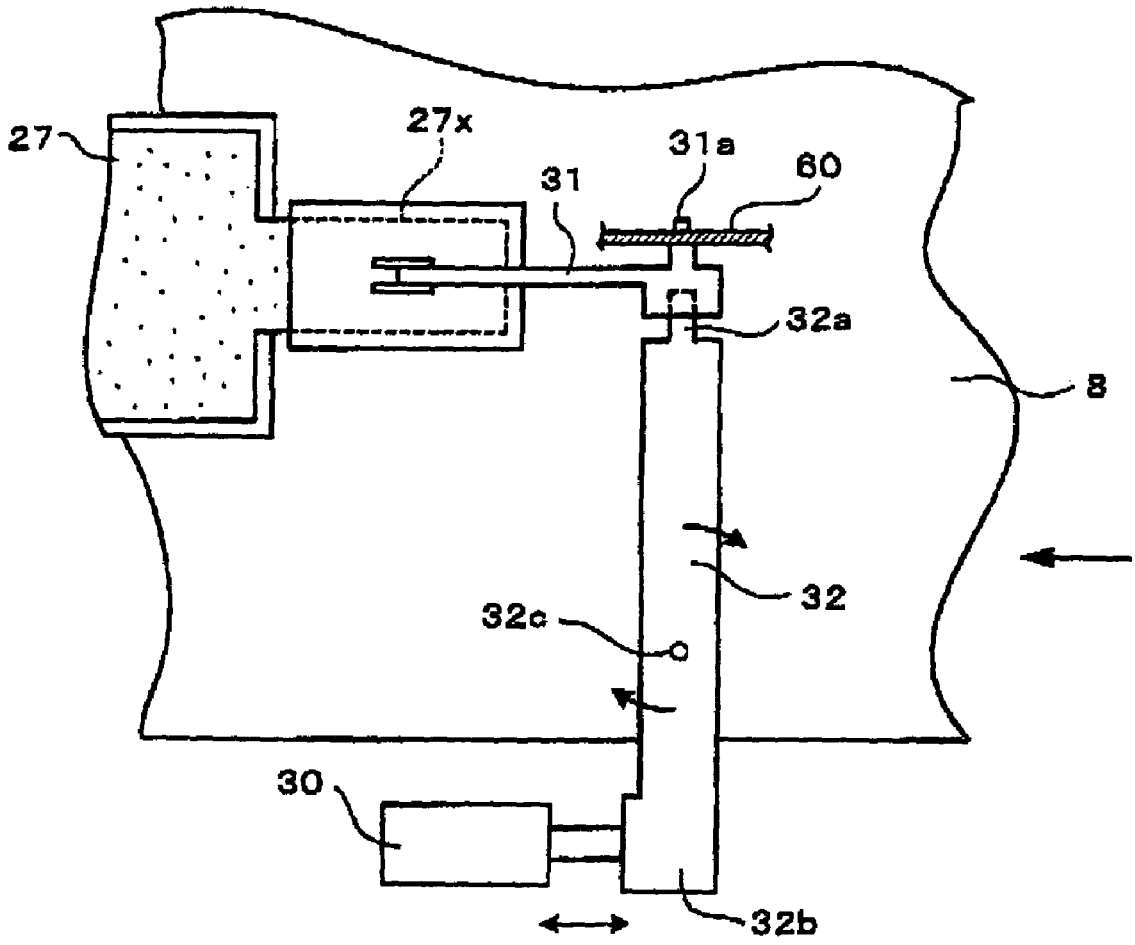
FIG. 5A is a partial plan view showing a drive mechanism of an ink absorber shown in FIG. 1.
Figure 5B:
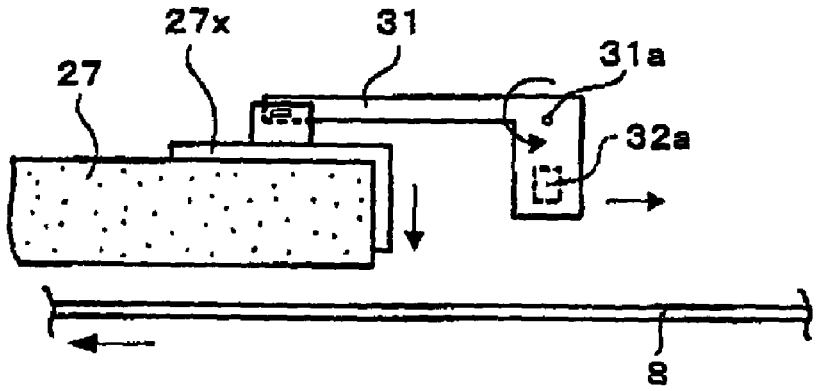
FIG. 5B is a side view seen from the foreground of FIG. 5A.

The ink absorber 27 having the substantially rectangular parallelepiped shape is disposed at the rear surface 80*a* of the conveyor belt 8 at a position near the roller 6 between the guide members 21*a* and 21*b*. Due to a drive mechanism such as a solenoid 30 shown in FIG. 5A, it is possible for the ink absorber 27 to selectively assume either of a position at which it contacts the conveyor belt 8 and a position at which it does not contact the conveyor belt 8. FIG. 5A is a partial plan view showing the drive mechanism of the ink absorber 27 shown in FIG. 1. FIG. 5A is also a view where the conveyor belt 8 is seen from the rear surface 80*a* thereof near the position at which the ink absorber 27 is disposed. FIG. 5B is a side view seen from the foreground of FIG. 5A.

As shown in FIG. 8A, a holder 27*x* made of resin holding the ink absorber 27 is supported at one end of a first link member 31. The other end of the first link member 31 is supported at a main body frame 60 via a shaft 31*a* and, as shown in FIG. 5B, an end 32*a* of a second link member 32 is fixed below the shaft 31*a* of this other end. The solenoid 30 is connected to another end 32*b* of the second link member 32. Due to the opening and closing of the solenoid 30, the other end 32*b* of the second link member 32 is moves in the direction of either right or left represented by the arrows in FIG. 5A. Also, the substantial longitudinal-direction center of the second link member 32 is supported from above by a main body frame not shown via a shaft 32*c*.

When the other end 32*b* of the second link member 32 moves to the left of FIG. 5A, i.e., to the direction approaching the solenoid 30, the second link member 32 rotates clockwise around the shaft 32*c* and the end 32*a* of the second link member 32 moves in the right direction of FIG. 5A conversely from the other end 32*b*. In so doing, as shown in FIG. 5B, the first link member 31 rotates counterclockwise around the shaft 31*a* and the ink absorber 27 supported at one end of the first link member 31 moves downward. The ink absorber 27 stops at the position where it contacts the rear surface 80*a* of the conveyor belt 8. The first link member 31 and the second link member 32 also operate in a reverse manner from that described above, whereby the ink absorber 27 is again disposed at a position away from the rear surface 80*a* of the conveyor belt 8.

This movement of the ink absorber 27 is conducted in accordance with the position of the non-water-repellent region 24*x*, which changes in accompaniment with the traveling of the conveyor belt 8. In other words, when the non-water-repellent region 24*x* is at the position corresponding to the ink absorber 27, the ink absorber 27 contacts the rear surface 80*a* of the conveyor belt 8, and when the non-water-repellent 24*x* is at a position not corresponding to the ink absorber 27, the ink absorber 27 is away from the rear surface 80*a* of the conveyor belt 8. This is realized by a solenoid 30 being opened and closed at a predetermined point in time on the basis of the position of the non-water-repellent 24*x* detected by the photosensor 40 (see FIG. 1) and the traveling speed of the conveyor belt 8.

For example, a time period from a time point when the photosensor 40 detects the non-water-repellent region 24*x* until this non-water-repellent region 24*x* reaches the position corresponding to the ink absorber 27, is calculated in advance, based on a distance along the conveyor belt between a position of the photosensor 40 and the position corresponding to the ink absorber 27 and on the traveling speed of the conveyor belt 8. Then the time period is stored. Accordingly, as a practical matter, after the photosensor 40 detects the non-water-repellent region 24*x* and then the stored time period passed, the ink absorber 27 is moved toward the conveyor belt 8 by the drive mechanism.

Figure 6A:
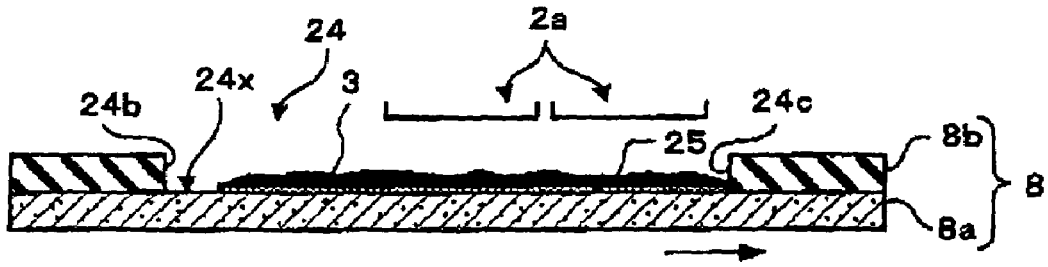
FIGS. 6A to 6D are enlarged cross-sectional views of the vicinity of a recessed portion at a belt width-direction center position of the conveyor belt, shown in a temporal sequence accompanying the traveling of the conveyor belt.
Figure 6B:
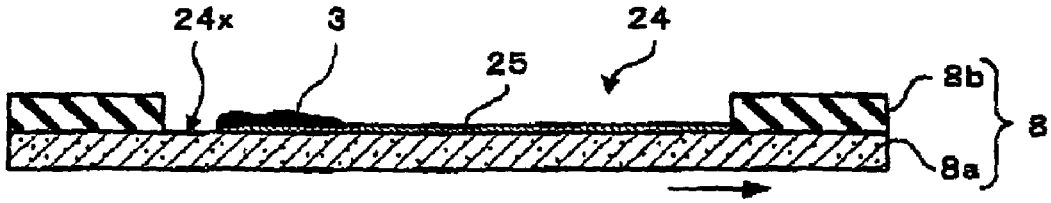
Figure 6C:
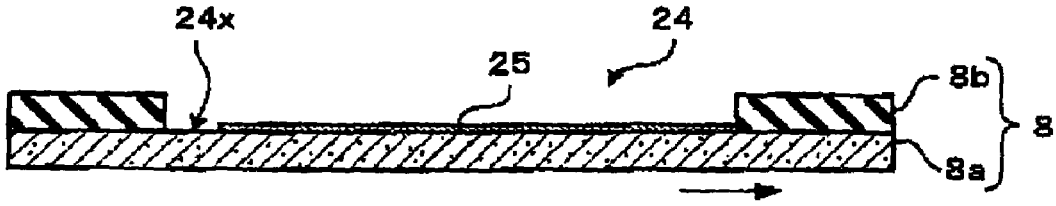
Figure 6D:
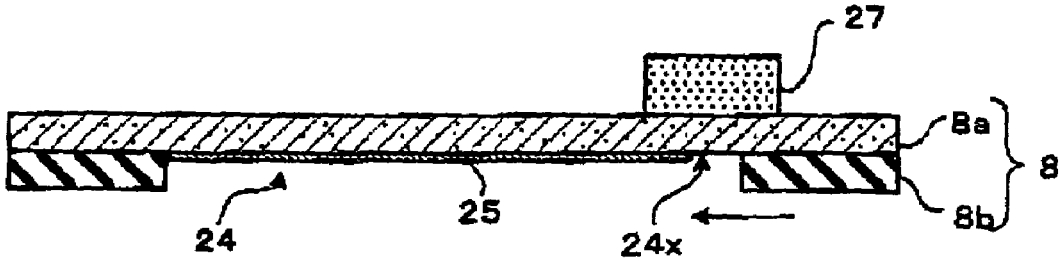

Next, the movement of ink flushed on the conveyor belt 8 will be described with reference to FIGS. 6A to 6D. FIGS. 6A to 6D are enlarged cross-sectional views of the vicinity of the recessed portion 24 at the belt width-direction center position of the conveyor belt 8, shown in a temporal sequence accompanying the traveling of the conveyor belt 8. FIGS. 6A to 6C show the point in time where the recessed portion 24 is on the upper path of the conveyor belt 8, and FIG. 6D shows the point in time where the recessed portion 24 is on the lower path.

In order to conduct the flushing, first, as shown in FIG. 6A, the conveyor belt 8 is made to travel to a position at which the region between the stepped portion 24*c* and the downstream end portion in the traveling direction (the direction represented by the arrow in FIG. 6A) of the stepped portion 24*a* (see FIGS. 2 and 3) of the recessed portion 24 faces the two head main bodies 2*a* near the roller 7 of the four head main bodies 2*a*. Then, after the traveling of the conveyor belt 8 is stopped, ink 3 is ejected or flushed towards the recessed portion 24 of the conveyor belt 8 from all of the nozzles of these two head main bodies 2*a*. Thus, the ejected ink 3 is disposed on the inner sheet 8*a*, more specifically, on the water-repellent sheet 25, that is the bottom surface of the recessed portion 24.

Thereafter, the conveyor belt 8 is made to travel so that the region between the traveling direction downstream end portion of the stepped portion 24*a* (see FIGS. 2 and 3) of the recessed portion 24 and the stepped portion 24*c* faces the two head main bodies 2*a* near the roller 6 of the four head main bodies 2*a*. Then, after the traveling of the conveyor belt 8 is stopped, the ink 3 is ejected towards the recessed portion 24 of the conveyor belt 8 from all of the nozzles of these two head main bodies 2*a*. In so doing, the ejected ink 3 is disposed on the inner sheet 8*a*, more specifically, on the water-repellent sheet 25, that is the bottom surface of the recessed portion 24.

When the conveyor belt 8 is made to travel in this state, the ink 3 moves in the direction opposite to the traveling direction, i.e., upstream in the traveling direction inside the recessed portion 24 due to inertia, and when the ink 3 reaches the stepped portion 24*a* as shown in FIG. 6B, it proceeds there along towards the apex 24*b*. When the ink 3 reaches the non-water-repellent region 24*x*, it seeps and is retained therein. Then, until the recessed portion 24 is positioned on the lower path by the traveling of the conveyor belt 8, most of the ink 3 reaches the non-water-repellent region 24*x* and is retained therein as shown in FIG. 5C.

Moreover, immediately after the conveyor belt 8 travels and the recessed portion 24 is positioned on the lower path, as shown in FIG. 6D, the non-water-repellent region 24*x* of the inner sheet 8*a* contacts the ink absorber 27 and passes therebelow. At this time, the ink 3 retained in the non-water-repellent region 24*x* is absorbed by the ink absorber 27 from the rear surface 80*a* of the conveyor belt 8. More specifically, the ink 3 is absorbed by the capillary force generated by the ink absorber 27 and discharged from the inside of the non-water-repellent region 24*x*. In other words, a material whose ink-retaining power is stronger than the ink-retaining power of the non-water-repellent region 24*x* is used as the ink absorber 27.

As described above, although the ink-jet printer 1 using the belt conveying mechanism 13 of this embodiment is a line-type printer, ink is ejected towards the recessed portion 24 without evacuating the conveyor belt 8 or the ink-jet heads 2, whereby rapid flushing becomes possible with a relatively simple configuration. Thus, manufacturing costs can be reduced, miniaturization of the ink-jet printer 1 is improved, and it also becomes possible to increase the printing rate per unit of time.

Also, because an opening for flushing is not formed and only the recessed portion 24 is disposed in the conveyor belt 8, there is little drop in the strength of the conveyor belt 8. Particularly in this embodiment, because the non-water-repellent region 24*x* where the water-repellent sheet 25 in the bottom surface of the recessed portion 24 is not formed serves as an ink retaining portion, the drop in the strength of the conveyor belt 8 is extremely small. Thus, a desired belt tension can be obtained, troubles do not arise in the paper conveying process, and there is virtually no reduction in the life of the conveyor belt 8.

Moreover, the ink 3 flushed in the recessed portion 24 is rapidly absorbed by the ink absorber 27 disposed at the inner peripheral side of the conveyor belt 8 via the non-water-repellent region 24*x*, whereby the ink 3 is rapidly removed from the outer peripheral surface of the conveyor belt 8. Thus, virtually no troubles arise during printing after flushing.

Also, because the portion excluding the non-water-repellent region 24*x* in the bottom surface of the recessed portion 24 is water-repellent due to the water-repellent sheet 25 being disposed, the ink 3 flushed in the region excluding the non-water-repellent region 24*x* of the bottom surface of the recessed portion 24 smoothly moves in the direction opposite to the traveling direction on the water-repellent sheet 25 in accompaniment with the traveling of the conveyor belt 8. Due to the ink 3 smoothly moving in this manner, it is possible to easily achieve retaining all of the flushed ink 3 in the non-water-repellent region 24*x* before the recessed portion 24 is positioned on the lower path.

Also, because the recessed portion 24 is of a "V" shape with the apex 24*b* at the traveling direction upstream side when seen from the front surface 80*b* of the conveyor belt 8, and because the non-water-repellent region 24*x* is disposed at the apex 24*b*, the rollers 6 and 7 and the guide members 21*a* and 21*b* do not become dirty with the ink in a wide range except for the portions corresponding to the non-water-repellent region 24*x*. Thus, belt slippage and transfer of ink to the paper from the rollers 6 and 7 and the guide members 21*a* and 21*b* can be held to a minimum.

In particular, as shown in FIG. 4, because the portions of the rollers 6 and 7 of this embodiment that the non-water-repellent region 24*x* passes at the time the conveyor belt 8 is traveling are cut out so that the annular recessed portions 6*a* and 7*a* are respectively formed, ink can be prevented from adhering to the rollers 6 and 7. Moreover, the guide members 21*a* and 21*b* disposed so as to contact the rear surface 80*a* of the conveyor belt 8 are disposed so as to exclude the portions corresponding to the recessed portions 6*a* and 7*a*, i.e., so as not to contact the portions corresponding to the non-water-repellent region 24*x*. Thus, ink can be prevented from adhering to the guide members 21*a* and 21*b*. Therefore, belt slippage resulting from the ink and transfer of ink to the paper virtually do not occur.

Also, it is possible for the ink absorber 27 to selectively assume either of a position at which it contacts the conveyor belt 8 and a position at which it does not contact the conveyor belt 8. More specifically, the ink absorber 27 is driven by the solenoid 30 on the basis of the position of the non-water-repellent region 24*x* detected by the photosensor 40 and the traveling speed of the conveyor belt 8, so that when the non-water-repellent region 24*x* is at the position corresponding to the ink absorber 27, the ink absorber 27 contacts the rear surface 80*a* of the conveyor belt 8, and when the non-water-repellent region 24*x* is at a position not corresponding to the ink absorber 27, the ink absorber 27 is away from the rear surface 80*a* of the conveyor belt 8. Thus, it becomes possible to hold friction between the ink absorber 27 and the conveyor belt 8 to a minimum. Also, because it is possible to reduce as much as possible ink that has seeped into the ink absorber 27 from adhering to the conveyor belt 8, there is the advantage that belt slippage and transfer of ink to the paper can be suppressed.

Figure 7:
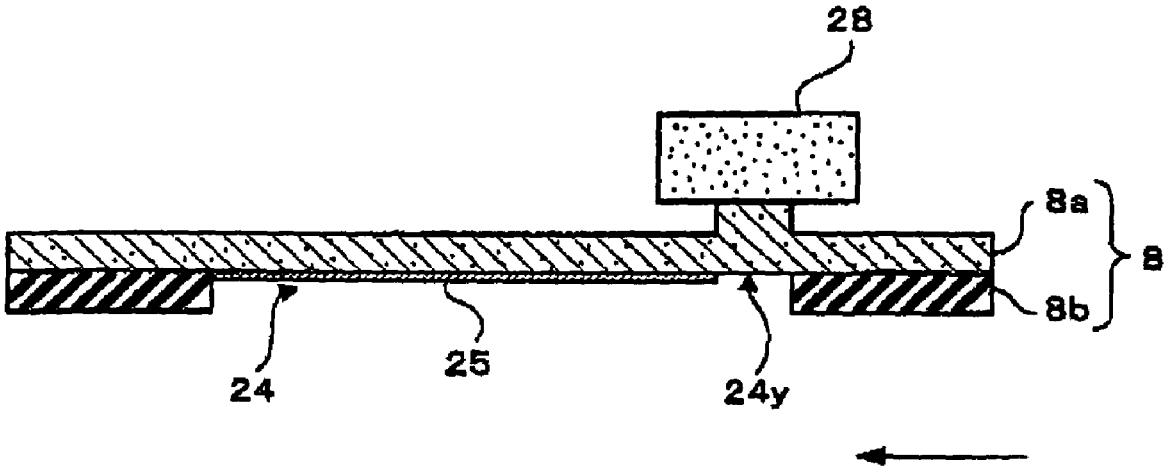
FIG. 7 is a cross-sectional view that corresponds to FIG. 6D and shows a modified example of the conveyor belt shown in FIG. 1.

It should be noted that, as shown in FIG. 7, a non-water-repellent region 24*y* serving as an ink retaining portion may also project from the rear surface 80*a* of the conveyor belt 8. In this case, it is preferable for a ink absorber 28 to be disposed so as to contact only the projecting portion of the non-water-repellent region 24*y* and not contact the rear surface 80*a* of the conveyor belt 8. Thus, dirtying of the rear surface 80*a* of the conveyor belt 8 can be suppressed.

Also, although the stepped portion 24*a* of the recessed portion 24 in this embodiment has a "V" shape as shown in FIG. 2, it may also have any of numerous other shapes such as a "U" shape or a "W" shape.

Moreover, the annular recessed portions 6*a* and 7*a* do not have to be disposed in the rollers 6 and 7, and the guide members 21*a* and 21*b* may also contact the portion of the conveyor belt 8 corresponding to the non-water-repellent region 24*x*.

Next, the overall configuration of an ink-jet printer 101 provided with a belt conveying mechanism 113 in accordance with a second embodiment of the invention will be described with reference to FIG. 8. With respect to the ink-jet printer 101 of this embodiment, the same reference numerals will be given to elements that are the same as those in the first embodiment, and detailed description of those elements will be omitted. The belt conveying mechanism 113 of this embodiment includes a guide member 121, ink retainers 127*a* and 127*b*, of which only the ink retainer 127*a* is indicated by the dashed dotted line in FIG. 8, and a conveyor belt 108. The ink retainers 127*a* and 127*b* are made of felt and substantially rectangular parallelepiped-shaped.

The guide member 121 does not comprise two members as the guide members 21*a* and 21*b* in the first embodiment do, but rather one member. In other words, the guide member 121 is a substantially rectangular parallelepiped having a width that is substantially the same as that of the conveyor belt 108. The ink retainers 127*a* and 127*b* do not comprise a single member as the ink retainer 27 in the first embodiment does, but rather two members. The ink retainers 127*a* and 127*b* are disposed at both width-direction sides of the conveyor belt 108 near the roller 6 on the upper path of the conveyor belt 108, and can selectively assume either of a position at which they contact the conveyor belt 108 and a position at which they do not contact the conveyor belt 108 (see FIG. 9), due to a drive mechanism such as a motor 130 described later (see FIGS. 12A and 12B).

Figure 10:
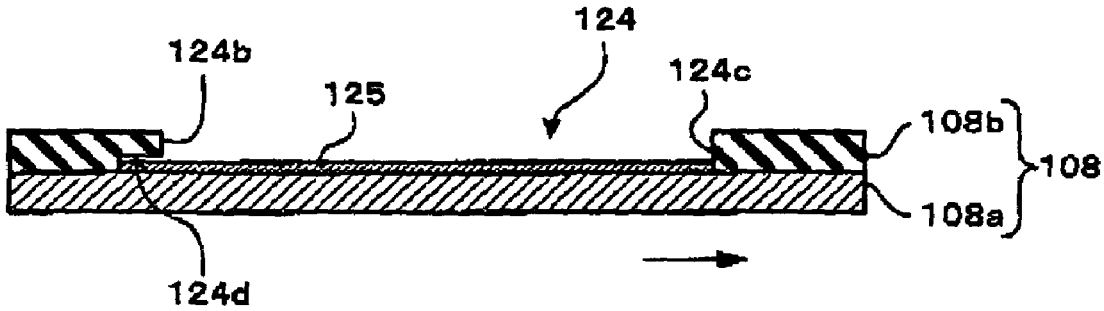
FIG. 10 is a partial cross-sectional view of the conveyor belt shown in FIG. 9.
Figure 11:
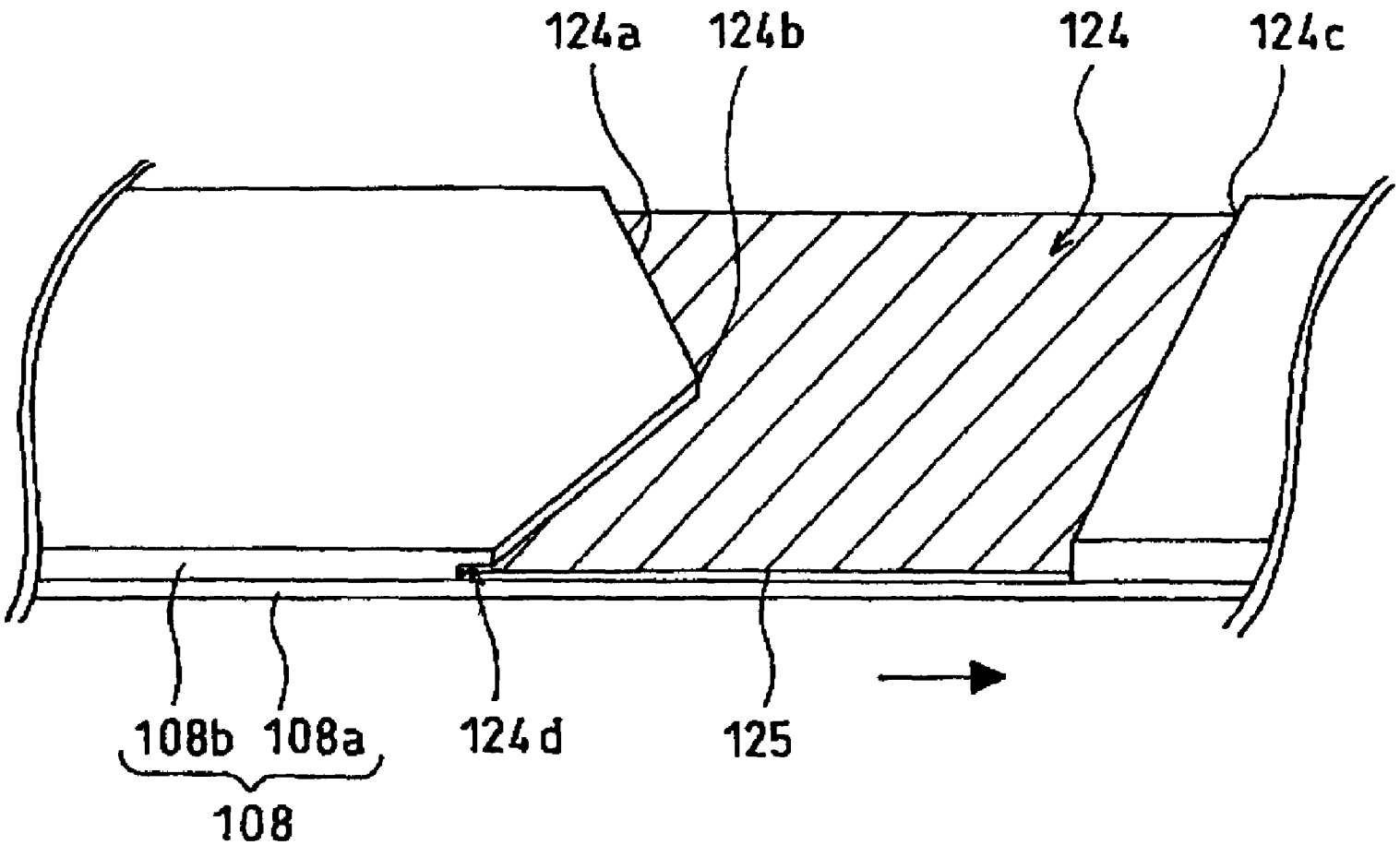
FIG. 11 is a partial perspective view of the conveyor belt shown in FIG. 9.

As shown in FIGS. 10 and 11, the conveyor belt 106 has a two-layer construction formed by two sheets being adhered together, as in the first embodiment. Part of an inner sheet 108*a* is not covered by an outer sheet 108*b*, whereby a single recessed portion 124 having a height that is the same as the thickness of the outer sheet 108*b* is disposed in the outer peripheral surface of the conveyor belt 108.

Figure 9:
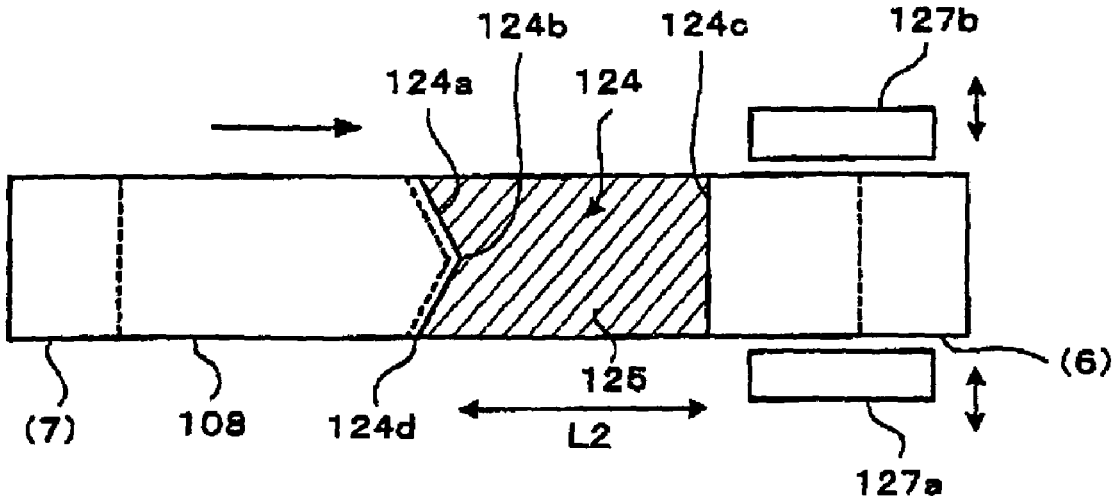
FIG. 9 is a partial plan view of a conveyor belt shown in FIG. 8.

As shown in FIGS. 9 to 11, the recessed portion 124 has a width that is equal to the width of the belt when seen in plan view. A stepped portion 124*a* upstream in the traveling direction is of a "V" shape, with an apex 124*b* directed downstream in the traveling direction at a width-direction center position of the belt. In other words, the stepped portion 124*a* is formed such that the width ends of the conveyor belt lie upstream in the traveling direction with respect to the width center. A stepped portion 124*c* downstream in the traveling direction is of a straight linear shape along the belt width direction.

As shown in FIGS. 10 and 11, the lower half of the stepped portion 124*a* contacting the inner sheet 108*a* is hollowed out to form a groove 124*d*, whereby the stepped portion 124*a* has an overhanging form whose upper end is oriented towards downstream in the traveling direction.

A water-repellent sheet 125 same as in the first embodiment is disposed on the bottom surface of the recessed portion 124, so that virtually no ink is absorbed.

In the recessed portion 124, a distance L2 (see FIG. 9) between the apex 124*b* and the stepped portion 124*c* is, similar to the distance L1 in the first embodiment (see FIG. 2), a distance that is somewhat longer than twice the width of a head main body 2*a*.

The position of the recessed portion 124 is detectable by a photosensor 140 (see FIG. 8) that is the same as the photosensor of the first embodiment.

Figure 12A:
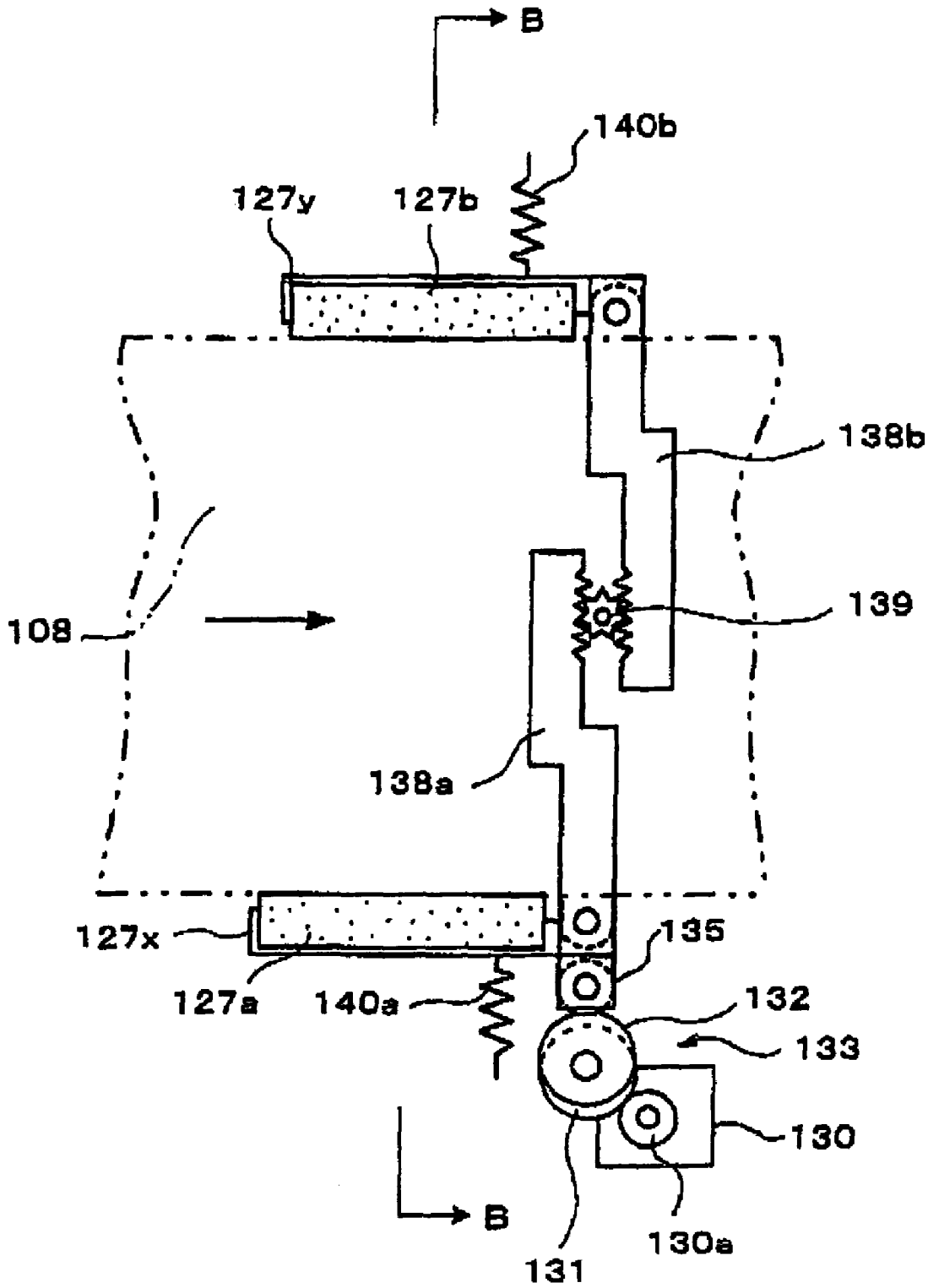
FIG. 12A is a partial plan view showing a drive mechanism of ink retainers shown in FIG. 9.

Here, the drive mechanism of the ink retainers 127*a* and 127*b* will be described. FIG. 12A is a partial plan view showing the drive mechanism of the ink retainers shown in FIG. 9. FIG. 12A is also a view seen from the front surface of the conveyor belt 108 near the disposed positions of the ink retainers 127*a* and 127*b*, with the conveyor belt 108 being represented by a dashed double-dotted line. FIG. 123 is a cross-sectional view along line B-B of FIG. 12A.

Figure 12B:
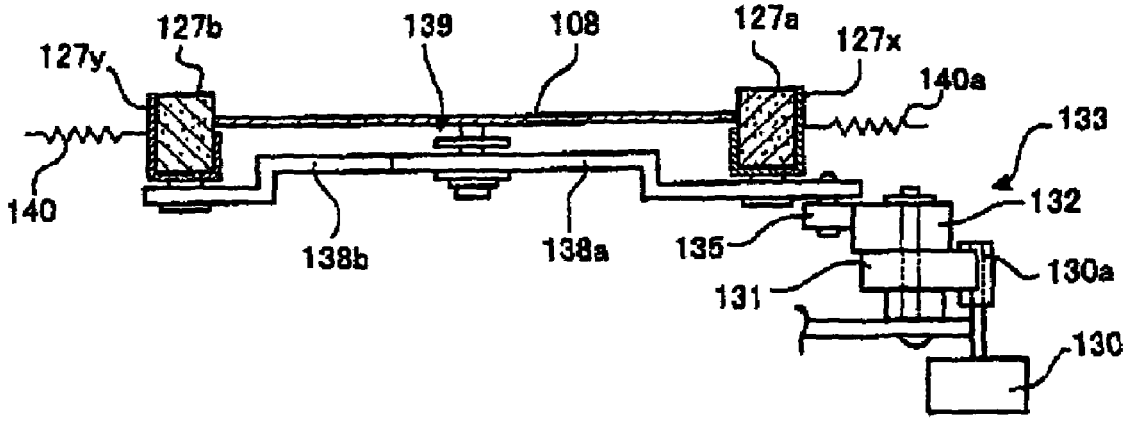
FIG. 12B is a cross-sectional view along line B-B of FIG. 12A.

As shown in FIGS. 12A and 12B, the ink retainers 127*a* and 127*b* are accommodated inside holders 127*x* and 127*y* that respectively comprise resin. The holders 127*x* and 127*y* are urged by springs 140*a* and 140*b* in directions away from the belt in the width direction of the conveyor belt 108. Racks 138*a* and 138*b*, which are disposed along the width direction of the conveyor belt 108 at the rear surface of the conveyor belt 108, are connected to ends of the holders 127*x* and 127*y*. The racks 138*a* and 138*b* intermesh at a substantially central portion of the conveyor belt 108 via a pinion 139.

The portion at which the holder 127*x* of the ink retainer 127*a* connects to the rack 138*a* extends outward in the width direction of the conveyor belt 108, and is connected to a cam portion 133 supported at a main body frame via a roller 135. The roller 135 meshes with an eccentric cam 132 in the cam portion 133. A cam gear 131 that is coaxial and interlocks with the eccentric cam 132 is disposed below the eccentric cam 132, and the cam gear 131 meshes with a motor gear 130*a* of the motor 130.

In this configuration, when the motor 130 forwardly rotates or reversely rotates, this rotation is transmitted to the motor gear 130*a*, the cam gear 131 and the eccentric cam 132. Because the eccentric cam 132 is eccentric with respect to the central axis, it moves together with the roller 135 in a direction approaching or a direction moving away from the conveyor belt 108 along the width direction of the conveyor belt 108. Thus, the holder 127*x* and the ink retainer 127*a* connected to the roller 135 move in a direction approaching or a direction moving away from the conveyor belt 108. Because the holder 127*y* of the ink retainer 127*b*, which is disposed facing the ink retainer 127*a*, is connected to the rack 138*a* via the pinion 139, the ink retainer 127*b* moves at the same time as the ink retainer 127*a* and in the opposite direction of the ink retainer 127*a*. In other words, the ink retainers 127*a* and 127*b* simultaneously move in a direction approaching or a direction moving away from the conveyor belt 108 along the width direction of the conveyor belt 108 due to the driving of the motor 130.

During the period of time in which the motor 130 is not being driven, the ink retainers 127*a* ad 127*b* and the holders 127*x* and 127*y* are all in positions away from the conveyor belt 108 due to the urging of the springs 140*a* and 140*b*. Also, when the ink retainers 127*a* and 127*b* move in the direction approaching the conveyor belt 108 along the width direction of the conveyor belt 108, they contact width end portions of the conveyor belt 108 and mutually stop at positions distanced by the amount of the width of the conveyor belt 108.

The movement of the ink retainers 127*a* and 127*b* is conducted in accordance with the position of the recessed portion 124, which changes in accompaniment with the traveling of the conveyor belt 108. In other words, when the recessed portion 124 is at a position corresponding to the ink retainers 127*a* and 127*b*, the ink retainers 127*a* and 127*b* contact the conveyor belt 108, and when the recessed portion 124 is at a position not corresponding to the ink retainers 127*a* and 127*b*, the ink retainers 127*a* and 127*b* move away from the conveyor belt 108. This is realized by the motor 130 driving at a predetermined point in time on the basis of the position of the recessed portion 124 detected by the photosensor 140 (see FIG. 8) and the traveling speed of the conveyor belt 108.

Next, the movement of ink flushed on the conveyor belt 108 will be described with reference to FIGS. 13A to 13D. FIGS. 13A to 13D are enlarged cross-sectional views of the vicinity of the recessed portion 124 at a belt width-direction center position of the conveyor belt 108, shown in a temporal sequence accompanying the traveling of the conveyor belt 108, and respectively show a case where the recessed portion 124 is on the upper path of the conveyor belt 108.

Figure 13A:
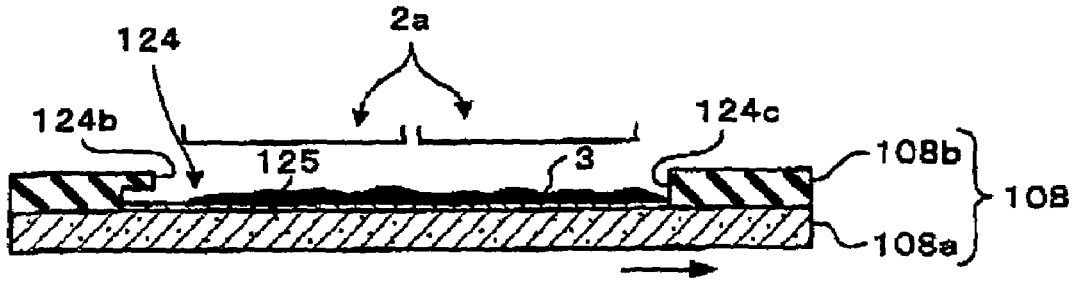
FIGS. 13A to 13D are enlarged cross-sectional views of the vicinity of a recessed portion at a belt width-direction center position of the conveyor belt, shown in a temporal sequence accompanying the traveling of the conveyor belt.
Figure 13B:
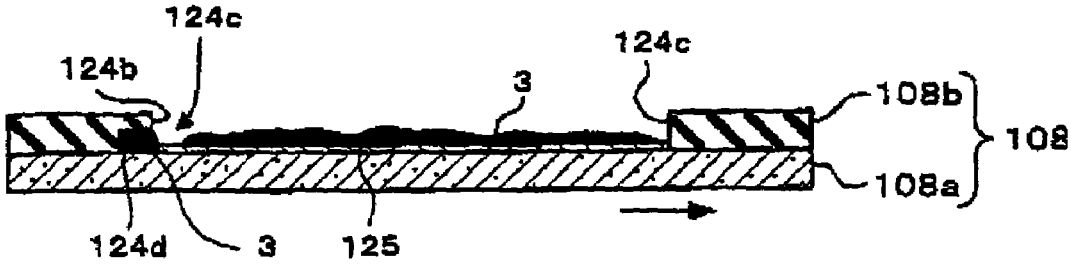
Figure 13C:
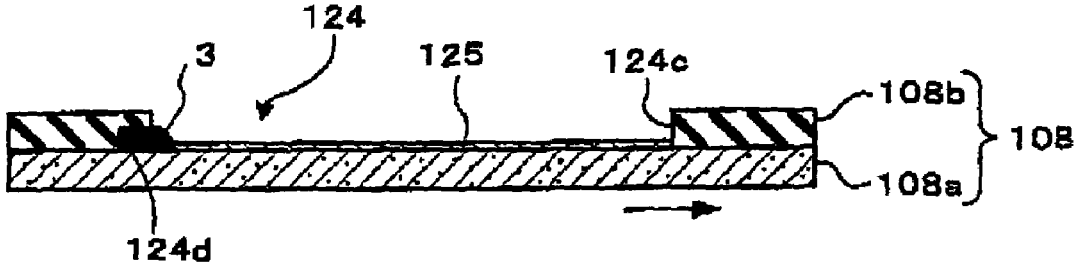
Figure 13D:
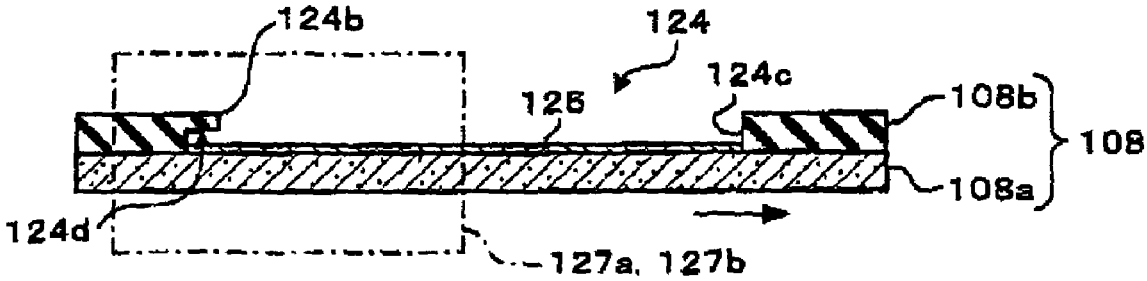

Flushing is conducted in the same manner as in the first embodiment. As shown in FIG. 13A, the ejected ink 3 is disposed on the inner sheet 108*a* that is the bottom surface of the recessed portion 124. When the conveyor belt 108 is made to travel in this state, the ink 3 moves in the direction opposite to the traveling direction, i.e., upstream in the traveling direction, inside the recessed portion 124 due to inertia, and after the ink 3 reaches the stepped portion 124*a* as shown in FIG. 13B, it moves there along towards both width ends of the conveyor belt 108. Then, as shown in FIG. 13C, virtually all of the ink 3 disappears from the inside of the recessed portion 124.

Moreover, when the conveyor belt 108 travels and the portions of the groove 124*d* corresponding to both width ends of the conveyor belt 108 contact the ink retainers 127*a* and 127*b*, the conveyor belt 108 is temporarily stopped at this timing. At this time, the ink 3 in the groove 124*d* is absorbed and retained in the ink retainers 127*a* and 127*b* due to the capillary force generated by the ink retainers 127*a* and 127*b*, and then discharged from the inside of the groove 124*d*.

It should be noted that the traveling speed of the conveyor belt 108 and the positions and sizes of the ink retainers 127*a* and 127*b* are set so that, at the point in time when the ink 3 moving inside the groove 124*d* initially reaches both width ends of the conveyor belt 108, those portions are already contacting the ink retainers 127*a* and 127*b*.

Also, even if the conveyor belt 108 continues to travel without being temporarily stopped when the ink 3 is retained in the ink retainers 127*a* and 127*b*, it is possible to discharge all of the ink 3 inside the groove 124*d* from the inside of the groove 124*d* by appropriately adjusting the traveling speed of the conveyor belt 108 and the positions and sizes of the ink retainers 127*a* and 127*b*.

As described above, according to the belt conveying mechanism 113 of this embodiment, the same effects as those of the first embodiment can be obtained in that rapid flushing becomes possible with a relatively simply configuration, the drop in the strength of the conveyor belt 108 becomes extremely small, and virtually no troubles arise in printing after flushing due to the ink 3 flushed in the recessed portion 124.

Moreover, similar to the first embodiment, because the bottom surface of the recessed portion 124 is water-repellent, the flushed ink 3 smoothly moves in the direction opposite to the traveling direction in the recessed portion 124 in accompaniment with the traveling of the conveyor belt 108. Thus, the ink 3 can be effectively absorbed by the ink retainers 127*a* and 127*b*.

Also, due to the drive mechanism such as the motor 130 shown in FIGS. 12A and 12B, similar to the first embodiment, the ink retainers 127*a* and 127*b* can selectively assume either of a position at which they contact the conveyor belt 108 and a position at which they do not contact the conveyor belt 108. Thus, similar to the first embodiment, friction between the ink retainers 127*a* and 127*b* and the conveyor belt 108 can be held to a minimum, and it is possible to reduce as much as possible ink that has seeped into the ink retainers 127*a* and 127*b* from adhering to the conveyor belt 108.

In addition to the aforementioned effects, in this embodiment, the ink 3 ejected inside the recessed portion 124 of the conveyor belt 108 does not adhere to places other than the ink retainers 127*a* and 127*b*, such as the rear surface of the conveyor belt 108 or the rollers 6 and 7. Thus, belt slippage resulting from the ink 3 and transfer of ink to the paper can be held to a minimum.

Also, because the stepped portion 124*a* includes the overhanging form whose upper end is oriented towards downstream in the traveling direction, energy of the ink 3 proceeding towards the stepped portion 124*a* can be dispersed inside the groove 124*d*, and cases where the flushed ink 3 crosses over the stepped portion 124*a* and leaks from the recessed portion 124 are reduced.

Moreover, because the stepped portion 124*a* has a "V" shape with the apex 124*b* at the traveling direction downstream side, the ink 3 moves towards both width ends of the conveyor belt 108 in accompaniment with the traveling of the conveyor belt 108. Thus, because the passing amount of ink at each width end portion is cut in half in comparison to a case where the ink 3 is guided to only one width end portion of the conveyor belt 108, cases where the flushed ink 3 leaks from the recessed portion 124 are reduced. Also, when the distance L2 is kept constant, the distance between the portions of the groove 124*d* corresponding to both width ends of the conveyor belt 108 and the stepped portion 124*c* can be shortened in comparison to a case where the ink 3 is guided to only one width end portion of the conveyor belt 108. In other words, because the entire length of the recessed portion 124 can be formed relatively short, it becomes easy to control the timing at which the paper is conveyed.

Figure 14:
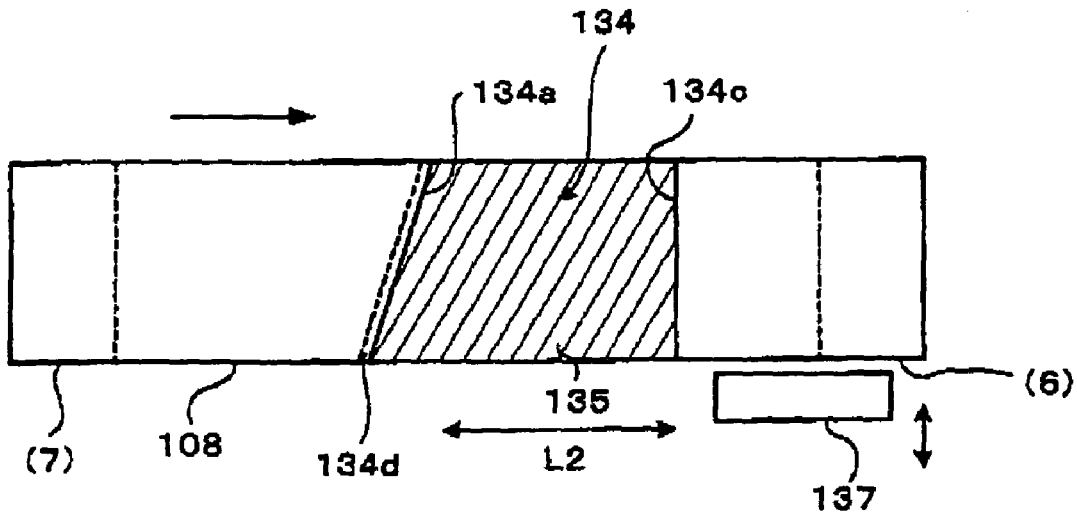
FIG. 14 is a partial plan view showing a modified example of the conveyor belt shown in FIG. 8.
Figure 15:
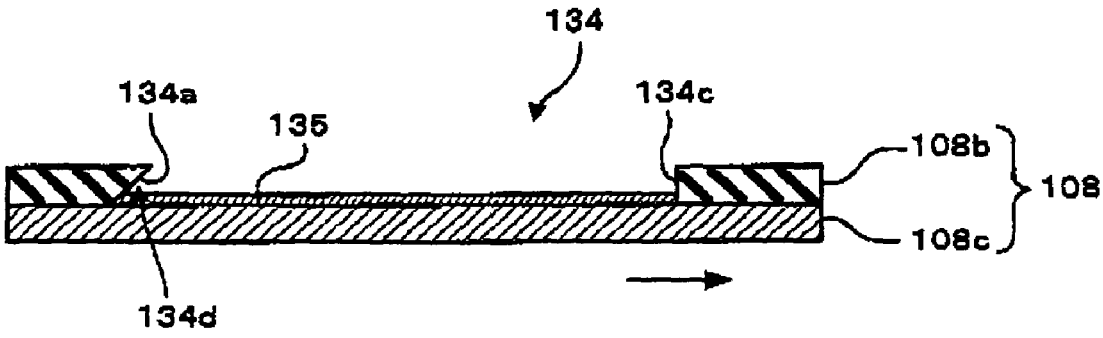
FIG. 15 is a partial cross-sectional view of the conveyor belt shown in FIG. 14.

Here, a modified example of the recessed portion in the second embodiment will be described with reference to FIGS. 14 and 15. FIG. 14 is a partial plan view showing a modified example of the conveyor belt shown in FIG. 8. FIG. 15 is a partial cross-sectional view of the conveyor belt shown in FIG. 14. Both FIGS. 14 and 15 show a case where a recessed portion 134 is on the upper path of the conveyor belt 108.

In this modified example, the recessed portion 134 is a trapezoid having a width that is equal to the belt width when seen in plan view. Additionally, a traveling direction upstream side stepped portion 134*a* thereof has a linear shape slanted by about 20° with respect to the belt width direction, and a traveling direction downstream side stepped portion 134*c* has a linear shape along the belt width direction. As shown in FIGS. 14 and 15, the cross section of the stepped portion 134*a* is slanted outward and downward from above the inner side of the recessed portion 134 so as to form an angle of about 45°. In other words, the stepped portion 134*a* has an overhanging form whose upper end projects downstream in the traveling direction, and the space below the stepped portion 134*a* forms a groove 134*d*.

According to this modified example, because a stepped portion 134*a* has the shape shown in FIG. 14, ink is guided to only one width end portion of the stepped portion 134*a* in accompaniment with the traveling of the conveyor belt 108. Thus, an ink retainer 137 is disposed only at one side of the conveyor belt 108, i.e., the side corresponding to the width end portion of the stepped portion 134*a* at the traveling direction upstream side, so that the configuration of the apparatus including the drive mechanism of the ink retainer 137 is simplified. In this case, the amount of ink guided to the one width end portion of the stepped portion 134*a* is about twice that of the case of FIG. 9.

It should be noted that, in this embodiment, the shapes of the traveling direction upstream side stepped portions 124*a* and 134*a* in the recessed portions 124 and 134 are not limited to a "V" shape or a linear shape as long as they can guide the ink to at least one width end portion.

Also, the stepped portions 124*a* and 134*a* do not always have to have an overhanging form oriented towards downstream in the traveling direction. Even in a case where the stepped portions 124*a* and 134*a* have an overhanging form, the shape thereof is not limited to the shape shown in the diagrams and can be changed to an optional shape.

Next, a belt conveying mechanism 213 in accordance with a third embodiment of the invention will be described with reference to FIGS. 16 and 17. Similar to the first and second embodiments, the belt conveying mechanism 213 of this embodiment is used in the ink-jet printers 1 and 101. With respect to the configuration thereof, the same reference numerals will be given to elements that are the same as those of the first and second embodiments, and description of those elements will be omitted.

Figure 16:
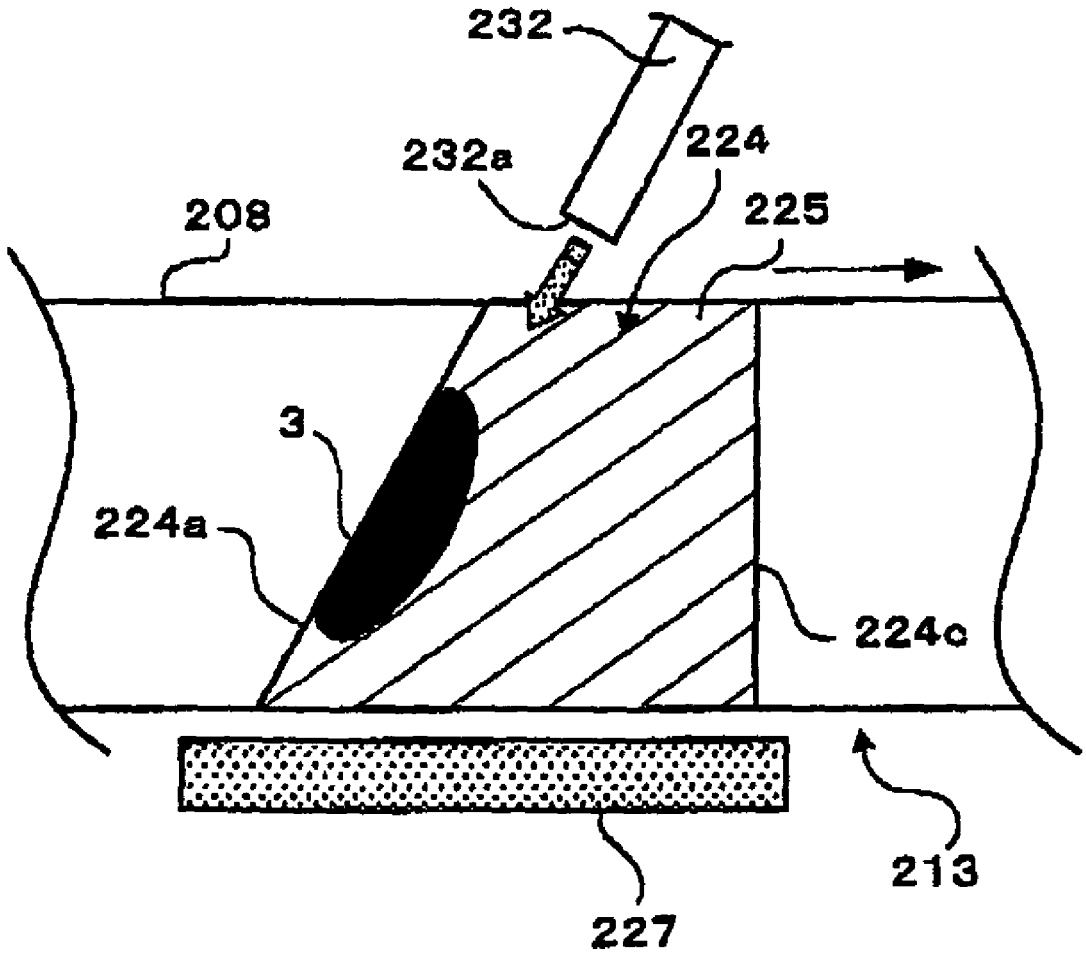
FIG. 16 is a partial plan view of a conveyor belt in a belt conveying mechanism in accordance with a third embodiment of the invention.

As shown in FIG. 16, a recessed portion 224 formed in a conveyor belt 208 is a trapezoid having a width that is the same as the belt width when seen in plan view, which trapezoid is the same as that of the recessed portion 134 (see FIG. 14) in the modified example of the second embodiment. A traveling direction upstream side stepped portion 224*a* of the recessed portion 224 is slanted upstream in the traveling direction from a direction intersecting the traveling direction. The direction of inclination of the stepped portion 224*a* in plan view is substantially along the direction in which air is delivered from a fan 230, i.e., a gas delivery member which will be described later. A traveling direction downstream side stepped portion 224*c* of the recessed portion 224 has a linear shape along the belt width direction. A water-repellent 225 same as that in the first and second embodiments is disposed on the bottom surface of the recessed portion 224, so that virtually no ink is absorbed.

Figure 17:
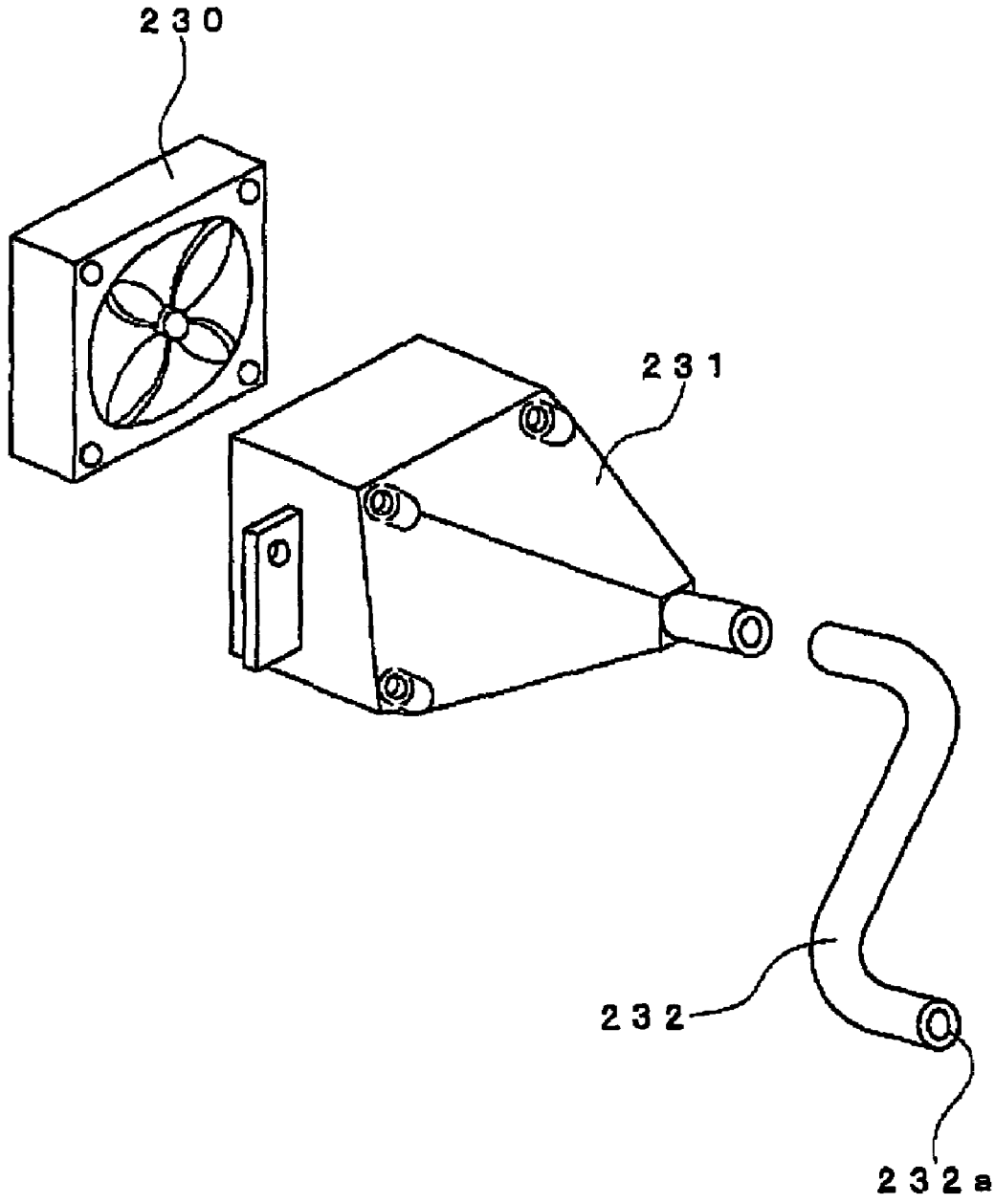
FIG. 17 is a schematic perspective view of a fan including an air delivery port shown in FIG. 16.

An air delivery port, or delivery portion 232*a*, through which air from the fan 230 shown in FIG. 17 is delivered, is disposed at one end side in the width direction of the conveyor belt 208. The air delivery port 232*a* is formed at an end of a tube 232 connected to the fan 230 via a holder 231. Air delivered from the air delivery port 232*a* moves along the front surface of the conveyor belt 208 and along the stepped portion 224*a* in the recessed portion 224.

An ink retainer 227, which is made of felt and substantially rectangular parallelepiped-shaped, same as the second embodiment, is disposed at the other width-direction end side of the conveyor belt 208 so as to face the air delivery port 232*a* of the fan 230 in the air delivery direction. The ink retainer 227 may be fixed in contact with or spaced from the conveyor belt 208, or, as in the first and second embodiments, the ink retainer 227 may selectively assume either of a position at which it contacts the conveyor belt 208 and a position at which it does not contact the conveyor belt 208. In this embodiment, as will be described later, the ink is moved at a relatively high speed by air from the fan 230 towards the ink retainer 227. Thus, even if the ink retainer 227 is fixed slightly away from the conveyor belt 208, the ink is prevented from adhering to places other than the ink retainer 227.

Figure 8:
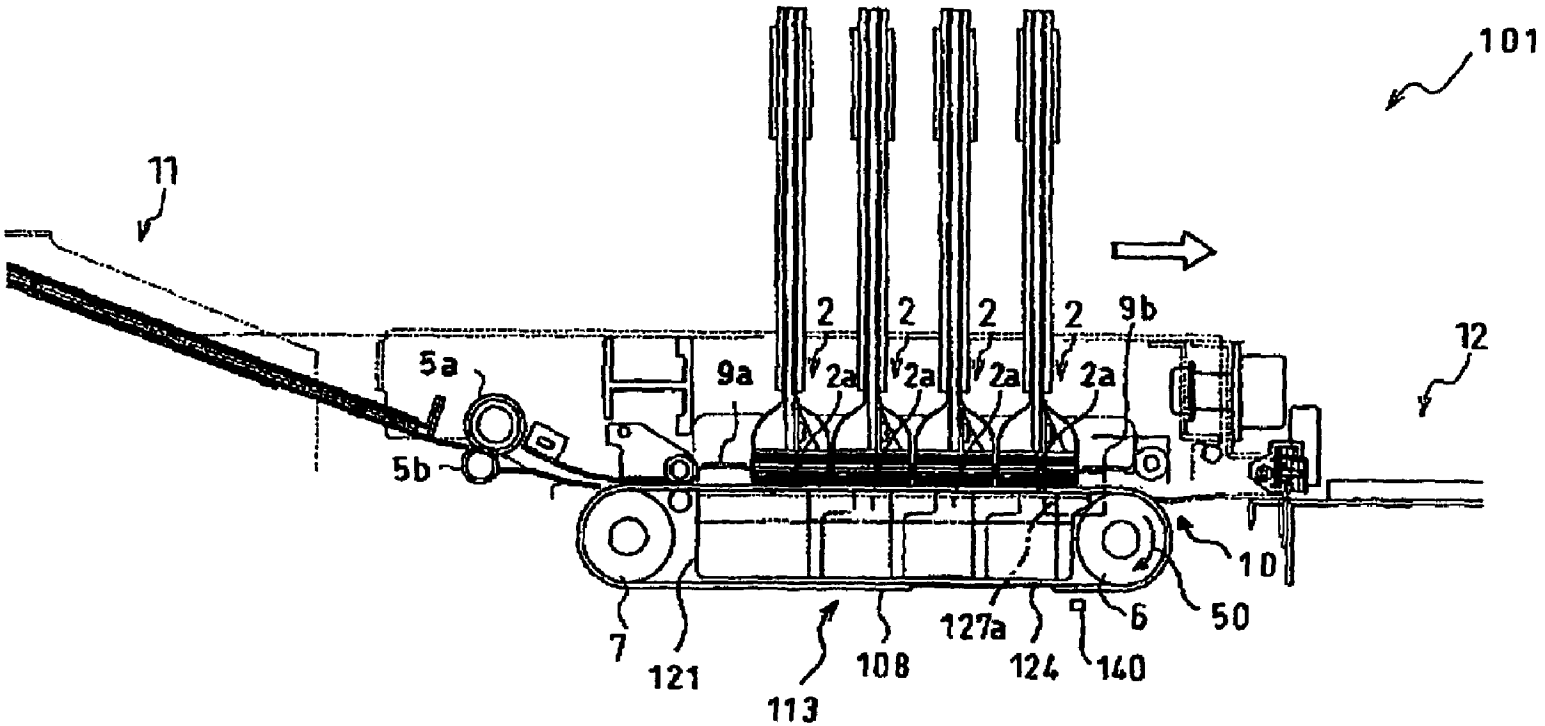
FIG. 8 is a front view showing an ink-jet printer provided with a belt conveying mechanism in accordance with a second embodiment of the invention.

The positions at which the ink retainer 227 and the delivery port 232 of the fan 230 are disposed are on the same upper path of the conveyor belt as in FIG. 8.

The ink 3 flushed inside the recessed portion 224 moves, in accompaniment with the traveling of the conveyor belt 208, in the direction opposite to the traveling direction, i.e., upstream in the traveling direction, inside the recessed portion 24 due to inertia. Then, because the stepped portion 224*a* at the traveling direction upstream side of the recessed portion 224 is slanted as described above, the ink is guided to only one width end portion of the stepped portion 224*a*. When the conveyor belt 208 moves and the recessed portion 224 reaches the position corresponding to the air delivery port 232*a* of the fan 230, the air from the fan 230 is delivered from the air delivery port 232*a*. The ink 3 moves together with the air from the fan 230 along the stepped portion 224*a*, is discharged from the recessed portion 224, and is absorbed and retained by the ink retainer 227.

It should be noted that the operation by which the air is delivered from the fan 230 and the ink 3 is absorbed by the ink retainer 227 may be conducted by temporarily stopping the conveyor belt 208 as in the second embodiment or may be conducted in a state in which the conveyor belt 208 is traveling.

As described above, according to the belt conveying mechanism 213 of this embodiment, the same effects as those of the first and second embodiments can be obtained in that rapid flushing becomes possible with a relatively simply configuration, the drop in the strength of the conveyor belt 208 becomes extremely small, and virtually no troubles arise in printing after flushing due to the ink 3 flushed in the recessed portion 224.

Moreover, similar to the first and second embodiments, because the bottom surface of the recessed portion 224 is water-repellent, the flushed ink 3 smoothly moves in the direction opposite to the traveling direction in the recessed portion 224 in accompaniment with the traveling of the conveyor belt 208. Additionally, ink 3 that has agglomerated in the stepped portion 224*a* can be effectively moved to the ink retainer 227 by the air from the fan 230.

Also, as shown in FIG. 16, because the direction in which the air is delivered from the fan 230 is slanted towards upstream in the traveling direction from the direction intersecting the traveling direction of the conveyor belt 208, the ink can be effectively removed even as the conveyor belt 208 is traveling. Moreover, in this embodiment, because the recessed portion 224 is formed in the conveyor belt 208 and the stepped portion 224*a* is substantially along the direction in which the air is delivered from the fan 230, the ink 3 moves to the other width-direction end positioned upstream in the traveling direction by inertia at the time the conveyor belt 208 is traveling. Thus, the ink 3 can be effectively removed.

Additionally, when a cooling fan disposed in the printer is used as the fan 230, a simpler configuration can be achieved without adding another member.

Also, because the positions at which the air delivery port 232*a* of the fan 230 and the ink retainer 227 are disposed are on the upper path of the conveyor belt 208 and the ink 3 can be reliably removed from the recessed portion 224 on the upper path of the conveyor belt 208, it is possible to alleviate problems such as ink remaining in the recessed portion 224 splattering and adhering to another member as it proceeds from the upper path to the lower path.

It is also possible to apply the fan 230 of this embodiment to the first and second embodiment so that the ink 3 can move more smoothly in the recessed portions 24, 124 and 134 and be more effectively retained in the non-water-repellent region 24*x* and the ink retainers 127*a*, 127*b* and 137.

It should be noted that, in the first, second and third embodiments, it is possible to change the distance, e.g., the distances L1 and L2 shown in FIGS. 2 and 9, between the traveling-direction downstream end portions of the stepped portions 24*a*, 124*a*, 134*a* and 224*a* in the recessed portions 24, 124, 134 and 224 and the stepped portions 24*c*, 124*c*, 134*c* and 224*c*, so that the distances are somewhat longer than the width of a head main body 2*a* or four times the width of a head main body 2*a*. In this case, the unit of the head main bodies 2*a* conducting flushing may be changed.

Also, a material other than polyester may be used as the material of the inner sheet. The ink absorber 27 and the ink retainers 127*a*, 127*b*, 137 and 227 are not limited to be made of felt.

Also, it is not always necessary for the conveyor belts 8, 108 and 208 to have a two-layer structure. For example, the conveyor belts may also have a layer structure of three or more layers or of only one layer.

Moreover, although the ink absorber 27 and the ink retainers 127*a*, 127*b*, 137 and 227 in the first and second embodiments are movable, the ink absorber in the first embodiment may also be fixed so as to continually contact the portion of the rear surface of the conveyor belt 8 corresponding to the non-water-repellent region 24*x*, and the ink retainers in the second embodiment may be fixed so as to continually contact the width end portions of the conveyor belt 108.

It is also possible to optionally change the disposed positions and sizes of the ink absorber 27 and the ink retainers 127*a*, 127*b*, 137 and 227 in a range that can sufficiently absorb the ink 3. For example, the ink absorber 27 of the first embodiment may have a length that is the same as the guide members 21*a* and 21*b* along the traveling direction, and the ink absorber 27 may contact the rear surface of the conveyor belt 8 on the upper path of the conveyor belt 8.

Also, the belt conveying mechanisms 13, 113 and 213 may be further provided with a function for discharging ink absorbed by the ink absorber 27 and the ink retainers 127*a*, 127*b*, 137 and 227 to the outside.

The invention is applicable not only to a line-type ink-jet printer but also to a serial-type ink-jet printer.

Moreover, the invention is not limited to an ink-jet printer but is applicable to, for example, ink-jet fax machines and copiers as well.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes nay be made without departing from the spirit and scope of the invention as defined in the following claims.

What is claimed is:

1. A belt conveying mechanism for an ink-jet recording apparatus, comprising:

a plurality of rollers;

a conveyor belt for conveying a record medium on a surface of the converor belt, the conveyor belt wrapped around the plurality of rollers;

a recessed portion formed in the surface of the conveyor belt;

an ink retaining portion for retaining ink, the ink retaining portion disposed upstream in a traveling direction of the conveyor belt and ranging from a bottom surface of the recessed portion to a rear surface of the conveyor belt; and an ink absorber for absorbing the ink retained by the ink retaining portion from the rear surface of the conveyor belt by contacting with the ink retaining portion, the ink absorber disposed at the rear surface of the conveyor belt.

2. The belt conveying mechanism for an ink-jet recording apparatus according to claim 1, wherein portions of the bottom surface of the recessed portion excluding the ink retaining portion are water-repellent, and wherein the ink retaining portion is non-water-repellent.

3. The belt conveying mechanism for an ink-jet recording apparatus according to claim 1, wherein the recessed portion has a "V" shape with its apex upstream in the traveling direction when viewed from the surface of the conveyor belt, and wherein the ink retaining portion is disposed at the apex.

4. The belt conveying mechanism for an ink-jet recording apparatus according to claim 1, wherein the rollers are cut out at portions through which the ink retaining portion passes at the time when the conveyor belt is traveling.

5. The belt conveying mechanism for an ink-jet recording apparatus according to claim 1, further comprising a guide member for supporting the conveyor belt, the guide member disposed in such a manner as to come into contact with at least part of the rear surface of the conveyor belt excluding portions through which the ink retaining portion passes at the time when the conveyor belt is traveling.

6. The belt conveying mechanism for an ink-jet recording apparatus according to claim 1, wherein the ink retaining portion projects from the rear surface of the conveyor belt, and wherein the ink absorber is disposed in such a manner as to come into contact with only the projecting portion of the ink retaining portion.

7. The belt conveying mechanism for an ink-jet recording apparatus according to claim 1, wherein the ink absorber selectively assumes a position at which it is brought into contact with the rear surface of the conveyor belt or a position at which it is not brought into contact with the rear surface of the conveyor belt.

8. The belt conveying mechanism for an ink-jet recording apparatus according to claim 1, wherein the ink absorber is made of felt.

9. A belt conveying mechanism for an ink-jet recording apparatus, comprising:

a plurality of rollers;

a conveyor belt for conveying a record medium on a surface of the converor belt, the conveyor belt wrapped around the plurality of rollers;

a recessed portion formed in the surface of the conveyor belt;

an ink retaining portion for retaining ink, the ink retaining portion disposed upstream in the traveling direction of the conveyor belt and ranging from a bottom surface of the recessed portion to a rear surface of the conveyor belt;

an ink absorber for absorbing the ink retained by the ink retaining portion from the rear surface of the conveyor belt by contacting with the ink retaining portion, the ink absorber disposed at the rear surface of the conveyor belt;

a sensor for detecting a position of the ink retaining portion formed in the conveyor belt; and a drive mechanism that moves the ink absorber based on the position of the ink retaining portion detected by the sensor and on the traveling speed of the conveyor belt such that, when the ink retaining portion is at a position corresponding to the ink absorber, the ink retaining portion is brought into contact with the rear surface of the conveyor belt, and that when the ink retaining portion is at a position not corresponding to the ink absorber, the ink retaining portion is apart from the rear surface of the conveyor belt.

10. An ink-jet recording apparatus, comprising:

the belt conveying mechanism according to claim 1; and an ink-jet head for ejecting ink onto the record medium being conveyed by the conveyor belt of the belt conveyor.

11. A belt conveying mechanism for an ink-jet recording apparatus, comprising:

a plurality of rollers;

a conveyor belt for conveying a record medium on a surface of the converor belt, the conveyor belt wrapped around the plurality of rollers;

a recessed portion formed in the surface of the conveyor belt such that ink moves towards at least one width end portion of the conveyor belt in accompaniment with the traveling of the conveyor belt; and an ink retainer for retaining the ink moved in the recessed portion, the ink retainer disposed at the width end portion.

12. The belt conveying mechanism for an ink-jet recording apparatus according to claim 11, wherein the bottom surface of the recessed portion is water-repellent.

13. The belt conveying mechanism for an ink-jet recording apparatus according to claim 11, wherein the recessed portion is formed such that the ink moves towards both width ends of the conveyor belt in accompaniment with the traveling of the conveyor belt.

14. The belt conveying mechanism for an ink-jet recording apparatus according to claim 11, wherein the recessed portion has a stepped portion upstream in the conveyor belt traveling direction such that at least one of the width end portions of the conveyor belt lies upstream in the traveling direction with respect to the width center of the conveyor belt.

15. The belt conveying mechanism for an ink-jet recording apparatus according to claim 14, wherein the stepped portion is formed such that the width end portions of the conveyor belt lie upstream in the traveling direction with respect to the width center of the conveyor belt.

16. The belt conveying mechanism for an ink-jet recording apparatus according to claim 11, wherein the recessed portion has a stepped portion upstream in the conveyor belt traveling direction such that the stepped portion is of an overhanging form whose upper end is oriented downstream of the traveling direction.

17. The belt conveying mechanism for an ink-jet recording apparatus according to claim 11, wherein the ink retainer selectively assumes a position at which it comes into contact with the conveyor belt or a position at which it does not come into contact with the conveyor belt.

18. A belt conveying mechanism for an ink-jet recording apparatus, comprising:

a plurality of rollers;

a conveyor belt for conveying a record medium on a surface of the converor belt, the conveyor belt wrapped around the plurality of rollers;

a recessed portion formed in the surface of the conveyor belt such that ink moves towards at least one width end portion of the conveyor belt in accompaniment with the traveling of the conveyor belt;

an ink retainer for retaining the ink moved in the recessed portion, the ink retainer disposed at the width end portion;

a sensor for detecting the position of the recessed portion formed in the conveyor belt; and a drive mechanism that moves the ink retainer based on the position of the recessed portion detected by the sensor and on the traveling speed of the conveyor belt, such that the ink retainer comes into contact or does not come into contact with the conveyor belt.

19. An ink-jet recording apparatus, comprising:

the belt conveying mechanism according to claim 11; and an ink-jet head for ejecting ink onto the record medium being conveyed by the conveyor belt of the belt conveyor.

20. A belt conveying mechanism for an ink-jet recording apparatus, comprising:

a plurality of rollers;

a conveyor belt for conveying a record medium on a surface of the converor belt, the conveyor belt wrapped around the plurality of rollers;

a gas delivery member for delivering a gas in a direction intersecting the traveling direction of the conveyor belt along the surface of the conveyor belt from the delivery portion, the gas delivery member including a delivery portion disposed at one width-direction end of the conveyor belt; and an ink retainer for retaining the ink moved under the action of the gas delivered from the gas delivery member, the ink retainer disposed at the other width-direction end of the conveyor belt, in such a manner as to face the delivery portion of the gas delivery member in the gas delivery direction.

21. The belt conveying mechanism for an ink-jet recording apparatus according to claim 20, wherein the gas delivery direction of the gas delivery member is slanted upstream in the traveling direction from a direction orthogonal to the traveling direction.

22. The belt conveying mechanism for an ink-jet recording apparatus according to claim 20, wherein the conveyor belt has on its surface a recessed portion including a stepped portion substantially along the gas delivery direction of the gas delivery member.

23. The belt conveying mechanism for an ink-jet recording apparatus according to claim 20, wherein the bottom surface of the recessed portion is water-repellent.

24. An ink-jet recording apparatus, comprising:

the belt conveying mechanism according to claim 20; and an ink-jet head for ejecting ink onto the record medium being conveyed by the conveyor belt of the belt conveyor.

* * * * *